US005378588A

United States Patent [19]

Tsuchiya

[11] Patent Number: 5,378,588

[45] Date of Patent: Jan. 3, 1995

[54] METHOD FOR PROCESSING SILVER HALIDE PHOTOGRAPHIC LIGHT-SENSITIVE MATERIALS WHICH CONSERVES AND REUSES OVERFLOW PROCESSING SOLUTIONS

[75] Inventor: Ichiro Tsuchiya, Hino, Japan

[73] Assignee: Konica Corporation, Japan

[21] Appl. No.: 95,090

[22] Filed: Jul. 20, 1993

[30] Foreign Application Priority Data

Jul. 25, 1992 [JP] Japan ..... 4-218678

[51] Int. Cl.[6] ..... G03C 5/18; G03C 5/26; G03C 5/38; G03C 7/00

[52] U.S. Cl. ..... 430/428; 430/393; 430/398; 430/400; 430/372; 430/458; 430/455; 430/418; 430/450

[58] Field of Search ..... 430/372, 393, 398, 400, 430/418, 428, 430, 450, 455, 458, 461, 465

[56] References Cited

U.S. PATENT DOCUMENTS

| | | | |
|---|---|---|---|
| 2,825,647 | 3/1958 | Fuller | 430/465 |
| 4,029,510 | 6/1977 | Speers | 430/458 |
| 5,053,321 | 10/1991 | Kühnert | 430/450 |
| 5,055,384 | 10/1991 | Kühnert | 430/450 |
| 5,135,840 | 8/1992 | Reuter et al. | 430/458 |
| 5,256,524 | 10/1993 | Yoshimoto et al. | 430/398 |
| 5,334,492 | 8/1994 | Werniobe et al. | 430/398 |

FOREIGN PATENT DOCUMENTS

| | | |
|---|---|---|
| 0430245 | 6/1991 | European Pat. Off. . |
| 0465076 | 1/1992 | European Pat. Off. . |
| 0479262 | 4/1992 | European Pat. Off. . |
| 0537365 | 4/1993 | European Pat. Off. . |

*Primary Examiner*—Charles L. Bowers, Jr.
*Assistant Examiner*—J. Pasterczyk
*Attorney, Agent, or Firm*—Jordan B. Bierman

[57] ABSTRACT

There is disclosed a method for processing a silver halide photographic light sensitive material comprising the steps of developing the light sensitive material with a developing solution, treating the light sensitive material with a fixing capacity-having solution, and then treating the light sensitive material with a processing solution (S), wherein part of or the whole of overflow from a tank containing the processing solution (S) is allowed to flow into a tank containing the fixing capability-having solution, and wherein solid processing chemicals are added to the fixing capacity-having solution or the overflow from the tank containing the processing solution (S).

8 Claims, 7 Drawing Sheets

METHOD FOR PROCESSING SILVER HALIDE PHOTOGRAPHIC LIGHT-SENSITIVE MATERIALS WHICH CONSERVES AND REUSES OVERFLOW PROCESSING SOLUTIONS

FIELD OF THE INVENTION

The present invention relates to a method for processing silver halide photographic light-sensitive materials, and more particularly to a silver halide photographic light-sensitive material processing method which is capable of stably forming an image, particularly a dye image with a good preservability and at the same time insure that unexposed areas are inhibited from staining, the process further having an improved aptitude for working environment as well as for social environment.

BACKGROUND OF THE INVENTION

A silver halide photographic light-sensitive material (hereinafter also called a light-sensitive material or photographic material), after being imagewise exposed, is processed in the procedure comprising steps of developing, desilvering, washing and stabilizing. A black-and-white developer solution or color developer solution is used for the developing processed; a bleaching solution, bleach-fix solution or fixer solution is used for the desilvering; city water or ion-exchanged water is used for the washing; and a stabilizer solution is used for the stabilizing. Each processing solution is kept at a temperature of 30° to 40° C., and a light-sensitive material is dipped and processed in the solution.

The processing is usually conducted in an automatic processor (hereinafter also called an autoprocessor) by threading a light-sensitive material in sequence through its baths filled with the above-mentioned solutions. In this instance, in order to keep the processing solution's activity in each bath constant, the autoprocessor conventionally employs replenishing systems to supply appropriate replenisher solutions to these bath solutions. To be concrete, the process progresses with these replenisher solutions being supplied from time to time from the respective replenisher tanks to the processing baths. In the above processing system, the replenisher solution to be stored in a replenisher tank is usually prepared in another place and at need supplied to the replenisher tank. The preparation of the replenisher solution, however, is conventionally made according to the following manual method:

Processing chemicals for silver halide photographic light-sensitive materials (hereinafter also called photographic processing chemicals) are conventionally available in either in a powdery form or in a concentrated liquid form to the user and, for use, in the case of powdery form, is dissolved in a specified amount of water to prepare a developer solution. The concentrated liquid form is mixed and diluted in a given amount of water to make a working developer solution.

In recent years there have been strong demands for protection of environment and resource saving mostly in and North America. In the photographic field, plastic containers for the foregoing concentrated processing liquid are in serious question; the plastic container for photographic processing chemicals is inexpensive, very convenient for storage and transport and excellent in the chemical resistance, but, when emptied, is buried, discarded or incinerated as an industrial waste. However, the plastic container is almost indecomposable and, when incinerated, emits a vast amount of carbon dioxide, which is a cause of the global warming issue. In addition, a problem on the side of autoprocessor operators occurs before the pile of such plastic containers in the workshop makes its narrow space still narrower.

As a solution to the above problems there have been various proposals; for example, JP O.P.I. No. 11032/1983 discloses a technique of microcapsulation of developer constituents; JP O.P.I. Nos. 109042/1990, 109043/1990, 39735/1991 and 39739/1991 disclose methods of using granulated photographic processing chemicals; and JP O.P.I. No. 61873/1976 discloses collapsing agent-containing photographic processing chemicals tablets. The above methods, however, tend to leave insoluble matter which causes clogging trouble with the filters inside the baths of the autoprocessor or which attaches to the light-sensitive material being processed to adversely affect its processing characteristics. Further, the tabletted processing chemicals described in the above publication comprise color developer and bleach-fix which are each of the type available in kits of chemicals parts, and has the disadvantage that the use of these tablets requires a dissolution with stirring in a replenisher tank provided therefor; the dissolution takes time and an erroneous dissolution may possibly occur. Accordingly, the inventors, in order to prevent such an erroneous dissolution, made an attempt to transform the chemicals into tablets of a single mixture of the chemicals, but the obtained tablets were poor in the solubility as well as in the preservability.

On the other hand, as a method requiring no dissolution work JP O.P.I. No. 11344/1991 discloses a technique for providing prepared chemicals by having pasty chemicals in necessary amounts corresponding to a mixing ratio extruded from their respective containers and having the extruded chemicals mixed and diluted to a specified concentration. This technique surely requires little or no dissolution work, but requires equipment such as a device for extruding chemicals, nozzle, supplier and the like, and also the strict maintenance thereof, and thus imposes a heavy burden on the operator responsible for it. Further, the technique has the disadvantage that the processing chemicals used therefor are poor in stability.

In photographic processing, reducing the processing liquid waste is strongly called for from the economical and environmental pollution point of view. Conventionally, as means to solve this problem there are conventionally known methods such as, for example, a method of making the washing bath into a multistage countercurrent water flow system; and a method of providing a preliminary washing bath immediately after the fixing bath to have the light-sensitive material being processed rinsed therein to thereby decrease pollutants which could be brought into the washing process by being contained in or attaching to the light-sensitive material. JP O.P.I. Nos. 14834/1983, 3448/1983, 235133/1986 and 212935/1988 describe methods of conducting a stabilization treatment upon completion of desilvering instead of washing, and methods of having the stabilizer bath overflow into a fixing bath, the bath precedent thereto. These methods are surely effective to some extent in reducing using amount of washing water or in reducing the amount of the waste by directly using a stabilizer solution, but because the replenishment of the processing solution is made with a liquid replenisher, reducing the amount of a replenisher causes degradation of the resulting photographic image preservability and an increase in stain, and therefore reducing the amount of the waste liquid has its limits. Further, as a technique to reduce the amount of the waste processing solution from the automatic processor a method for recovering wash water by using an ion-exchanging resin or a reverse osmosis device is disclosed in JP O.P.I. No. 52140/1988. However, in the above method there is a limit to reducing the amount of the waste liquid because of the limit to the recovering rate of wash water. In addition, it has the problem that providing the above-mentioned equipment in and around the washing bath makes the autoprocessor costly.

Further, JP O.P.I. No. 282460/1991 discloses a technique powdery-type processing chemicals are automatically supplied to an overflow from the preceding processing bath. In this method there is no problem of preservability in the powdery chemicals supplied, but it is difficult for the automatic supplier described in the above publication to accurately weigh out a prescribed amount of the powdery chemicals and to adequately protect the chemicals from moisture, so that it is almost impossible to always automatically stably supply the powdery chemicals.

SUMMARY OF THE INVENTION

It is an object of the present invention to provide a light-sensitive material processing method which enables one to significantly reduce the discharge amounts of waste plastic packages, waste processing solutions and waste wash water and which has an excellent aptitude for working environment as well as for social environment.

It is another object of the invention to provide a light-sensitive material processing method capable of stably processing a light-sensitive material to form an image with its preservability improved and at the same time with its unexposed area inhibited from staining.

The objects of the invention can be accomplished by the following light-sensitive material processing method:

In a light-sensitive material processing method having a process comprising a fixing capacity-having processing solution bath and a processing bath subsequent thereto, wherein part of or the whole of the overflow from the processing bath subsequent to the fixing capacity-having bath is allowed to flow into the fixing capacity-having bath, and solid photographic processing chemicals are added to the fixing capacity-having processing solution bath or the overflow from the processing bath subsequent thereto.

BRIEF DESCRIPTION OF TEE DRAWINGS

Figure 7:
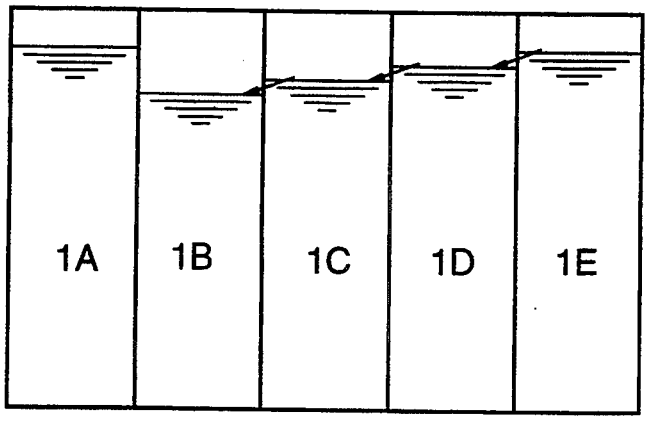
Figure 7:
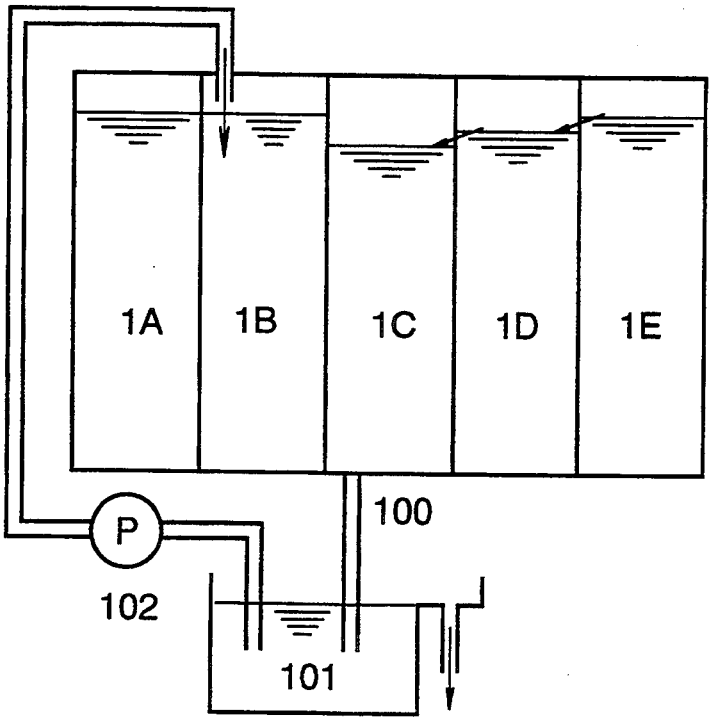

FIGS. 7(A) and 7(B) are schematic diagrams of two preferred embodiments of the invention.

DETAILED DESCRIPTION OF THE INVENTION

A preferred embodiment of the invention is such that the solution in the process subsequent to the foregoing fixing capacity-having process contains substantially no formaldehyde, and the fixing capacity-having process is either a fixing process or a bleach-fix process.

Another preferred embodiment of the invention is such that the amount of the overflow which flows into the fixing capacity-having processing bath accounts for not less than more preferably not less than 25%, and most preferably 100% of the total amount thereof.

Still another preferred embodiment of the invention is such that the foregoing silver halide photographic light-sensitive material is one comprising a support having thereon at least one emulsion layer of which the silver halide emulsion contains silver halide grains containing not less than 90 mol % silver chloride, and the total amount of the overflow from the process subsequent to the fixing capacity-having process is preferably not more than 660 ml, more preferably 30 to 500 ml, and most preferably 50 to 350 ml per $m^2$ of the light-sensitive material.

A further preferred embodiment of the invention is such that the foregoing silver halide photographic light-sensitive material comprises a support having thereon at least one emulsion layer whose silver halide emulsion contains silver halide grains containing not less than 6 mol % silver iodide, and the total amount of the overflow from the process subsequent to the fixing capacity-having process is preferably not more than 2000 ml, more preferably 30 to 1500 ml, and most preferably 60 to 1200 ml per $m^2$ of the light-sensitive material.

With regard to the addition of solid processing chemicals directly to the bath, we, the inventors, repeatedly conducted vast experiments to find an optimum amount of the replenisher to be added at each replenishing time to the processing solution in order not to fluctuate the photographic processing properties thereof. The optimum replenishing amount had been considered dependent upon the automatic processor's bath size, i.e., the capacity for a processing solution, but by making the most of the lower solubility of solid chemicals in water, it has been found that the chemicals have the advantage that even when a good amount thereof are added at a time, the concentration of the processing solution does not rise quickly, whereby very stable photographic processing characteristics can be provided. The fixed idea, 'they must be used after being completely dissolved,' has been found to be a wall of common sense. Further, the use of part of or the whole of an overflow from the processing bath in combination with the timely addition of replenishing water for dissolution of solid processing chemicals enables to obtain still more stable photographic characteristics and to make the autoprocessor of a more compact type.

The amount of the processing chemicals to be added at a time is preferably 0.1 to 50 g; 1 to 20 g to a color developer solution, 5 to 50 g to a fixer or bleach-fix solution, 0.1 to 10 g to a stabilizer solution and 0.5 to 20 g to a black-and-white developer solution. Even when solid processing chemicals in the above amount range are added directly to the processing bath of a general small autoprocessor to be slowly dissolved for processing, it does not adversely affect photographic characteristics because, as described above, the solid processing chemicals, not quickly, so slowly dissolve even when a large amount thereof is added at a time as to be consumed as needed to balance the specific composition to thereby indicate stable processing characteristics. And it has been found that the timely addition of replenishing water for dissolution or the use of part of or the whole of an overflow can also maintain photographic characteristics constant. This matter is a surprising discovery no one has ever become aware of. In the invention, solid processing chemicals are put directly in the processing bath, in which the processing solution is always kept at a temperature maintained almost constant suitable for processing. That is, since the dissolving rate is nearly constant throught the year, the calculated addition of solid processing chemicals to balance the constituents of the processing solution can be accomplished. It has been found that this matter at the same time have a great merit that there occurs no insolubilized phenomenon that is seen when dissolving in cold water. The 'insolubilized phenomenon' we named is a phenomenon of solid processing chemicals to become hardened to appear glassy, which occurs when the chemicals are once cast in cold water and slowly or little stirred. The chemicals once made glassy cannot easily dissolve even when vigorously stirred. In contrast, in the case of dissolution in warm water at a processing temperature in an autoprocessor, it has been found that even when solid processing chemicals tablets are en masse rapidly cast in, they dissolve gradually sequentially. Thus, the present invention has been completed.

In the invention, a replenishing water supply means is preferably provided. The water supply is preferably controlled through a photographic light-sensitive material's processing quantity detection means that is necessary for controlling the addition of solid processing chemicals. It should be emphasized that the above replenishing water is not for dissolving solid processing chemicals. That is, the solid processing chemicals are essential to make up for the shortage of certain components consumed by processing, while the replenishing water is for the purpose of diluting the concentration of a reaction restraining component eluted from the light-sensitive material by processing to thereby obtain consistent photographic characteristics; thus both functions are quite contrary. Conventionally, water was used for dissolving chemicals, but is essentially for making up for the shortage of water carried out by the light-sensitive material being processed and evaporated from the tank surface, and at the same time for diluting the concentration of accumulated components eluted from the light-sensitive material by its processing. Therefore, the water supply control can be made separately from the control of the addition of solid processing chemicals, but the use of a control by a light-sensitive material's processing quantity detection means is preferred since it enables the omission of the sensor.

Accordingly, in the invention where solid processing chemicals are added directly to the processing bath, it is not necessary to use water for only preparation of a replenisher solution, bringing a large secondary effect that decreases the amount of an overflow from the bath. There have been a conventional common sense that a replenisher solution must be prepared beforehand, so that a replenisher solution having a highest possible concentration have been used for replenishment. The higher the concentration, the smaller the amount of the replenisher solution used can be, thereby making it possible to reduce the waste overflow that comes into environmental question; —this is obvious, but has been unable to be achieved because of the processing chemicals' solubilities constituting a barrier. According to the invention, the use of solid processing chemicals leads substantially to no more than the bath solution concentration, no higher concentration condition exists, and the supplied are necessary processing chemicals alone, so that it is possible to make replenishment with no overflow at all.

However, it is preferable to use replenishing water in order to lower the aforementioned accumulation of reaction restraining components, particularly the halide ion concentration in the developer solution and the silver ion concentration in the fixer or bleach-fix solution. This replenishing water, in addition to the above purpose of lowering the concentrations of accumulated reaction restraining components, may also be used to make up for the shortage of water lost by being carried out by the light-sensitive material as well as by evaporation from the bath surface, which contributes remarkably raising the processing stability of the invention.

Accordingly, the control information for use in the replenishing water supply includes the processing quantity (area) and time of the light-sensitive material processed, temperature adjusting time, downtime, environmental temperature and humidity of the place where the autoprocessor is installed, dissolution rate of solid processing chemicals, and the like. If the supply amount of replenishing water is controlled by these pieces of information, the chemicals components of the processing bath can be checked under ideal conditions, which can be considered an epoch-making management method for photographic characteristics because it was conventionally a grave concern that the lower the replenishment rate, the more did the processing component become thickened due to evaporation from the bath. Generally speaking, in order to compensate the loss by evaporation, it is most preferred to dilute the replenisher solution to supply it in a large quantity, but this method leads to increasing the amount of waste overflow to adversely affect environment, and therefore the low replenishment-rate processing has been prevailing. If the replenisher solution is used to make up for the loss by evaporation, it means that the replenishing component comes in even when no processing operation is in progress, and it causes the components concentrations to become unbalanced. Then the way of supplying water to fill the bath up to its original liquid level was prevalent, but this is not to supply water to make up for the loss of water by evaporation but to merely add water to the processing solution contracted due to its temperature lowered, so that it is far from any basic solution to the problem.

A correct compensation for evaporation is a compensation made so as not to affect the composition of the processing solution except changes in the composition due to consumption by the photographic light-sensitive material being processed, and is to make up for the loss of water due to the temperature and vapor pressure on the surface of the bath by supplying water in an amount corresponding to the amount of the loss regardless of whether processing is made or not.

In the invention, the supply of replenishing water is made for the following three purposes: (1) To dilute the concentration of the accumulated undesirable restraining components eluted by the reaction in processing a light-sensitive material, (2) to make up for the loss of water carried away by the light-sensitive material in processing or to dilute unnecessary chemicals carried in from the preceding bath, and (3) to make up for the loss of water evaporated from the surface of the bath. Detection of necessary pieces of information for the above purposes is made to thereby control and execute the operation of an in advance set water supply means. The above is a novel method that has never existed before, and has been made feasible by the present invention. The water supply means of the invention has been found to enable to remarkably improve the processing stability. In the invention, solid processing chemicals are preferably weighed out into a prescribed amount, more preferably in advance dividedly weighed out into prescribed amount parts. Therefore, the processing in the automatic processor in the invention is made with a high replenishing accuracy to thereby exhibit very stable running processing characteristics. The above-mentioned 'in advance dividedly weighed out . . . ' implies that solid processing chemicals are already dividedly weighed out into fixed amount parts prior to being held in the autoprocessor of the invention or prior to being packed in packages to be set to the fixing means of the autoprocessor; which corresponds to, e.g., the embodiment of the processing chemicals formed into tablets or pills or into granules or powder dividedly packed into fixed amount packages, which does not include an embodiment in which powder or granules are put in a holding means from which an amount thereof to be added at a time is weighed out each time when supplied. In the conventional replenishing system, the supply was made by use of a bellows pump, but the pump's accuracy is not constant, so it is not suitable for the replenishment control that requires a high accuracy.

On the other hand, the solid processing chemicals of the invention are already produced, for example, in the form of being dividedly weighed out into fixed amount parts in the manufactory thereof, and the replenishment with the solid processing chemicals is carried out by an ON/OFF control representing whether the processing chemicals are added or not, so that there is no fluctuation in the replenishment. Thus, the processing chemicals supplying accuracy is markedly high, whereby a stable processing capacity can be obtained. The solid processing chemicals of the invention may take any forms such as powder, granules, tablets or pills, or a mixture of these forms. In the case of a safe chemical in a liquid state like water, even the use of such a liquid in combination with the solid chemicals can accomplish the object of the invention. Tablets or pills are most suitable for dividedly weighing. In the case of granulated or powdery chemicals, it is preferable that they, after being dividedly weighed out, be separately packed in packages made of an alkali-soluble film, plastic film or paper.

That is, tablets or pills are in themselves to provide accurately dividedly weighed out chemicals, while powder or granules, by being dividedly weighed out and separately packed, can complete the solid processing chemicals for the invention. Tablets or pills can be protected from moisture by being covered with a water-soluble moisture-tight polymer or other moisture-tight material. Protection of powder or granules from moisture can be achieved by having dividedly weighed out doses each wrapped with a selected moisture-proof packing material.

In the invention, for at least one of the processing baths a different processing solution, which is part of or the whole of an overflow from the different processing bath may be utilized as replenishing water. In utilizing the overflow, the supply of it may be made by utilizing its gravity as usually seen in the multistage counter-current system or by forcibly supplying by means of a bellows pump. It is apparent that the utilization of the overflow as replenishing water makes it possible to decrease the discharge amount of waste processing solution, but the combination of it with the solid processing chemicals of the invention can efficiently decrease even the water content of the conventional-type replenisher solution, thereby enabling to obtain an adequate processing capacity. Not only that, the use of the solid processing chemicals gets rid of concern about the weighing accuracy; enables to largely decrease the amount of replenishing water required in the invention; and therefore also enables to make the replenishing water tank more compact, thus leading to realization of a more compact-type automatic processor and reduction in the working load. And it is also possible to speed up processing. These are considered epocal discovery.

Further, if the overflow from the processing bath is utilized as replenishing water to the preceding bath, since the effective constituents of the preceding bath carried out by the light-sensitive material in processing also contained in the overflow, the required amount of the solid processing chemicals as well as of water to be supplied to the processing bath can be reduced.

Useful examples of the processing steps for the processing method of the invention include:

(1) Color developing—bleach-fix—stabilizing
(2) Color developing—bleaching—fixing—stabilizing
(3) Color developing—bleaching—bleach-fix—stabilizing
(4) Color developing—bleach-fix—fixing—stabilizing
(5) Color developing—bleach-fix—bleach-fix—stabilizing
(6) Color developing—bleaching—bleach-fix—fixing—stabilizing The preferred among the above are the processes (1), (2) and (3). Namely, in the invention, the fixing capacity-having processing solution includes a bleach-fix solution and a fixing solution, and the processing solution after the fixing capacity-having solution means a stabilizer solution. The fixing capacity-having processing solution is hereinafter called merely a bleach-fix solution or a fixing solution, and the stabilizer solution that replaces conventional washing is hereinafter also called merely a stabilizer solution.

The bleaching or bleach-fix solution, stabilizer solution, solid photographic processing chemicals for use in replenishing the stabilizing, fixing or bleach-fix solution, and color developer solution are explained. The processing chemicals used as starters or replenishers of these processing solutions are preferably in the solid form.

The bleaching agent useful for the bleaching solution or bleach-fix solution in the invention is one of ferric complex salts of organic acids represented by the following Formulas A-I to A-IV.

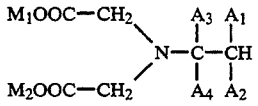

Formula A-I wherein $A_1$ to $A_4$ may be either the same as or different from one another and each represent a hydrogen atom, a hydroxy group, $—COOM_3$, $—PO_3(M_4)_2$, $—CH_2COOM_5$, $—CH_2OH$ or a lower alkyl group such as methyl, ethyl, isopropyl, n-propyl, provided that at least one of $A_1$ to $A_4$ is $—COOM_3$, $—PO_3(M_4)_2$ or $—CH_2COOM_5$; and $M_1$ to $M_5$ each represent a hydrogen atom, an ammonium group, an alkali metal atom such as sodium, potassium, lithium, or an organic ammonium group such as trimethylammonium, triethanolammonium.

The following are suitable examples of the compound represented by Formula A-I.

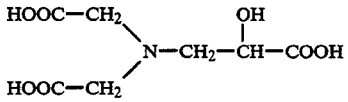

A-I-1

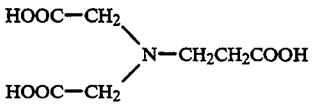

A-I-2

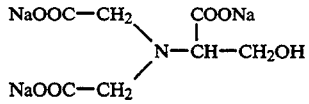

A-I-3

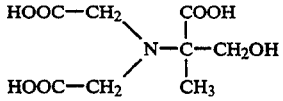

A-I-4

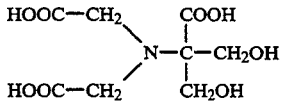

A-I-5

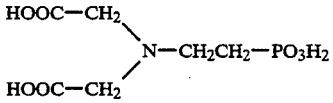

A-I-6

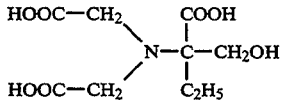

A-I-7

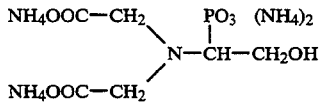

A-I-8

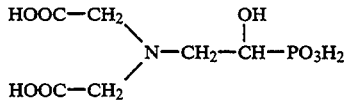

A-I-9

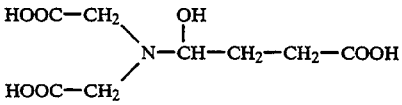

A-I-10

-continued

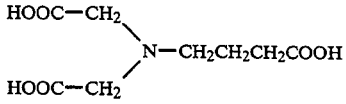

A-I-11

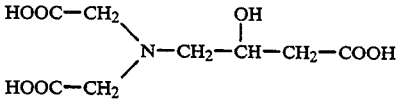

A-I-12

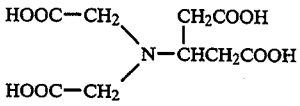

A-I-13

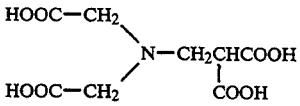

A-I-14

The above compounds represented by Formula A-I can be synthesized according to those common synthesis methods described in JP O.P.I. Nos. 267750/1988, 267751/1988, 115172/1990 and 295954/1990. The most preferred among the above exemplified compounds A-I-1, A-I-2, A-I-13 and A-I-14.

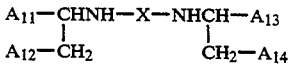

Formula A-II wherein $A_{11}$ to $A_{14}$ may be either the same or as different from one another and each represent $—CH_2OH$, $—PO_3(M_6)_2$ or $—COOM_7$, wherein $M_6$ and $M_7$ each represent a hydrogen atom, an ammonium group, an alkali metal atom such as sodium, potassium, or an organic ammonium group such as methylammonium, trimethylammonium; X represents a substitutable alkylene group having 2 to 6 carbon atoms or $—(B_1O)_n—B_2$, wherein $B_1$ and $B_2$ each may be either the same as or different from each other and each represent a substitutable alkylene group having 1 to 5 carbon atoms. The alkylene group represented by X is ethylene, trimethylene or tetramethylene. The alkylene group represented by $B_1$ or $B_2$ is methylene, ethylene or tremethylene. The substituent to the alkylene group represented by X, $B_1$ or $B_2$ is a hydroxy group or an alkyl group having 1 to 3 carbon atoms such as methyl or ethyl. n is an integer of 1 to 8, preferably 1 to 4.

The following are suitable examples of the compound represented by Formula A-II.

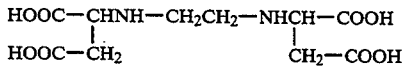

A-II-1

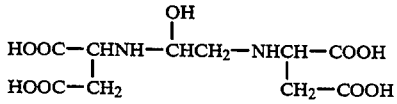

A-II-2

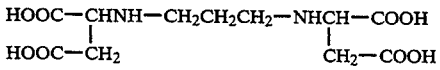

A-II-3

-continued

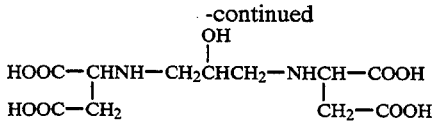
A-II-4

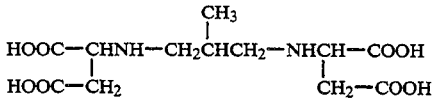
A-II-5

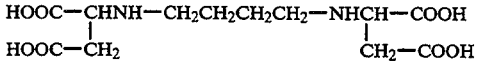
A-II-6

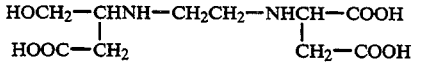
A-II-7

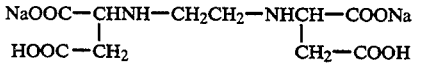
A-II-8

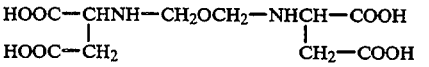
A-II-9

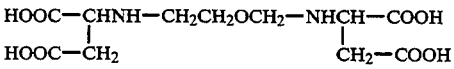
A-II-10

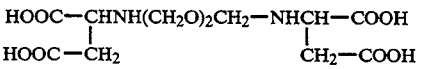
A-II-11

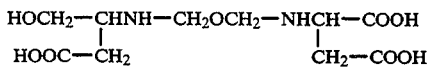
A-II-12

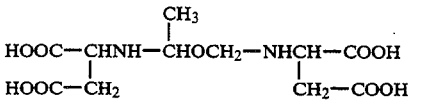
A-II-13

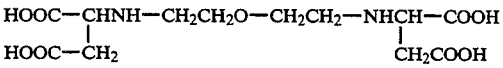
A-II-14

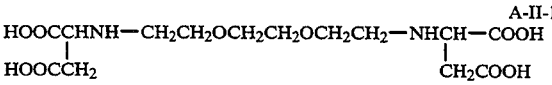
A-II-15

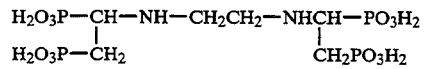
A-II-16

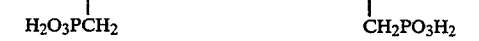
A-II-17

The above exemplified compounds of Formula A-II can be synthesized according to generally known synthesis methods.

The most preferred among the above listed compounds are A-II-1, A-II-3 and A-II-14.

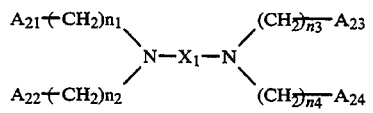
Formula III wherein $A_{21}$ to $A_{24}$ may be either the same as or different from one another and each represent $-CH_2OH$, $-PO_3(M_2)_2$ or $-COOM_1$, wherein $M_1$ and $M_2$ each represent a hydrogen atom, an ammonium group, an alkali atom such as sodium, potassium, or an organic ammonium group such as methylammonium, trimethylammonium; $X_1$ represents a straight-chain or branched-chain alkylene group, a ring-forming saturated or unsaturated organic group, or $-(B_{11}O)n_5-B_{12}$; $B_{11}$ and $B_{12}$ may be either the same as or different from one another and each represent a substitutable alkylene group having 1 to 5 carbon atoms; and $n_1$ to $n_4$ each represent an integer of 1 or above and may be either the same or different, provided at least one of them is 2 or more. The alkylene group represented by $X_1$ is ethylene, methylene or tetramethylene. The alkylene group represented by $B_{11}$ or $B_{12}$ is methylene, ethylene or trimethylene. The substituent to the alkylene group represented by $X_1$, $B_{11}$ or $B_{12}$ is a hydroxyl group or an alkyl group having 1 to 3 carbon atoms such as methyl or ethyl. $n_5$ is an integer of preferably 1 to 8, more preferably 1 to 4, and most preferably 1 or 2.

The following are suitable examples of the compound represented by Formula III.

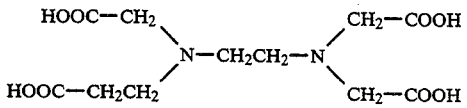
A-III-1

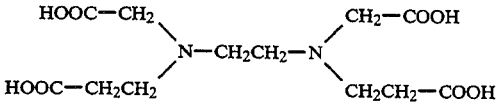
A-III-2

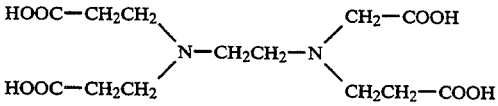
A-III-3

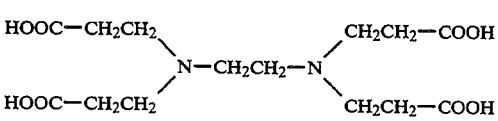
A-III-4

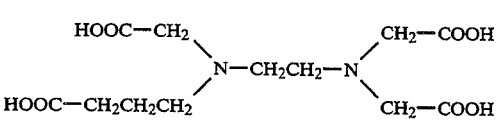
A-III-5

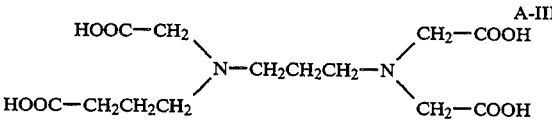
A-III-6

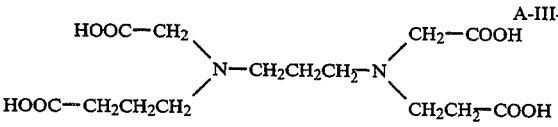
A-III-7

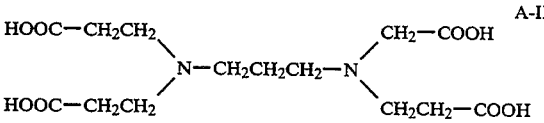
A-III-8

-continued
A-III-9
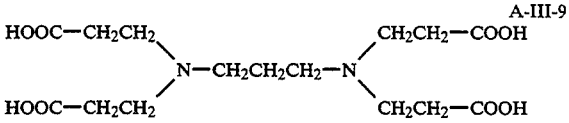
A-III-10
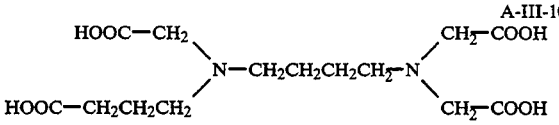
A-III-11
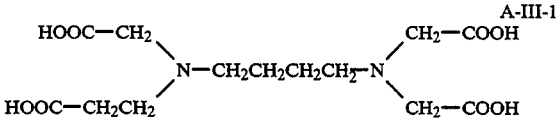
A-III-12
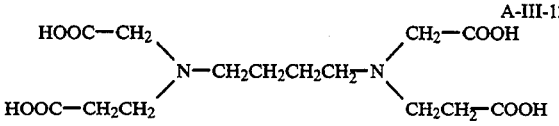
A-III-13
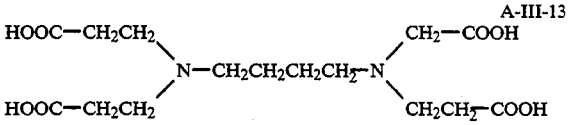
A-III-14
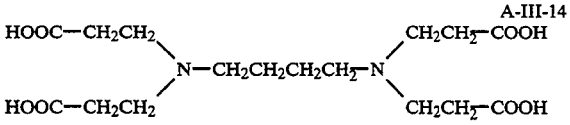
A-III-15
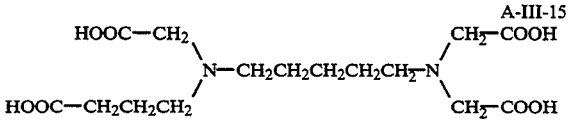
A-III-16
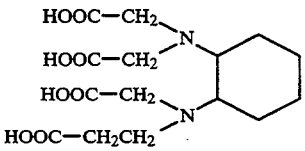
A-III-17
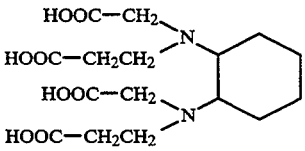
A-III-18
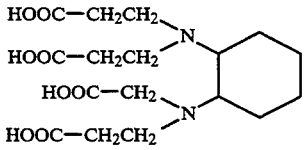
A-III-19
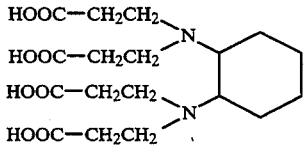
-continued
A-III-20
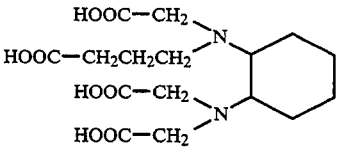
A-III-21
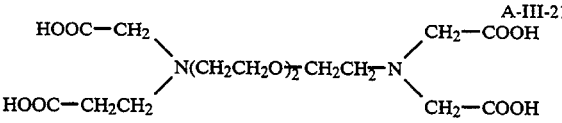
A-III-22
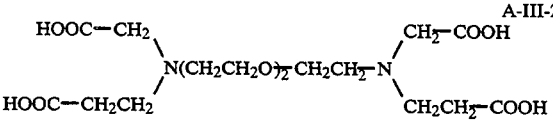
A-III-23
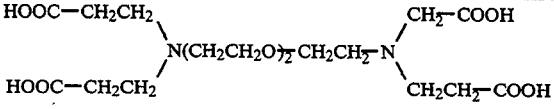
A-III-24
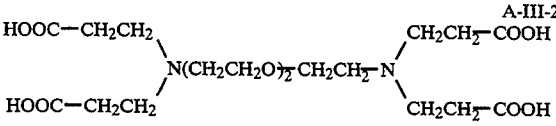
A-III-25
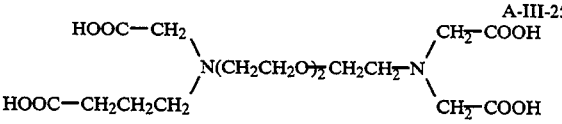
A-III-26
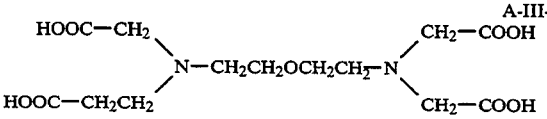
A-III-27
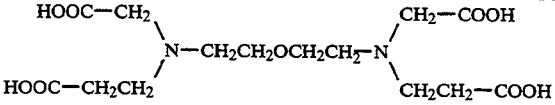
A-III-28
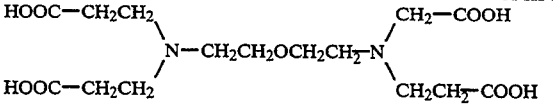
A-III-29
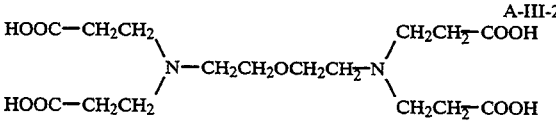
A-III-30
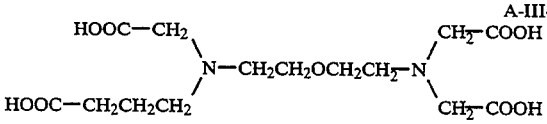
A-III-31
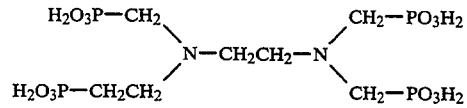

-continued

A-III-32

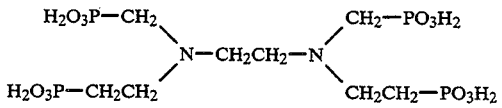

A-III-33

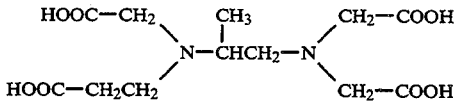

A-III-34

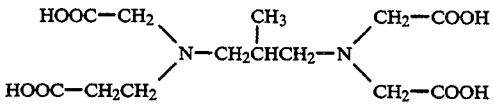

A-III-35

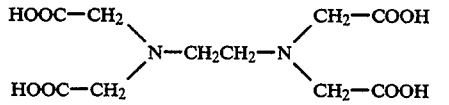

A-III-36

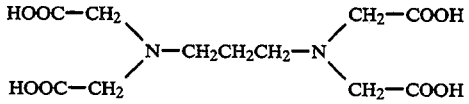

A-III-37

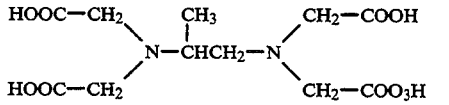

A-III-38

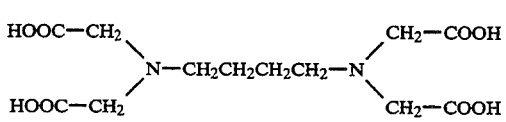

A-III-39

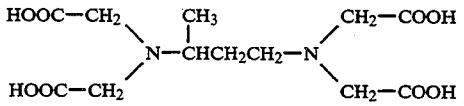

A-III-40

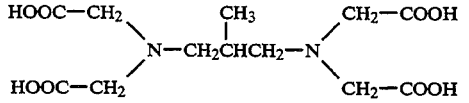

A-III-41

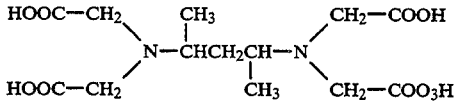

The above compounds A-III-16, A-III-17, A-III-18, A-III-19 and A-III-20 include both cis-type and trans-type compounds.

The above exemplified compounds can be synthesized according to generally known methods.

The most preferred among the above are compounds A-III-1, A-III-2 and A-III-6.

The adding amount of any one of ferric complex salts of Compounds represented by Formulas A-I to A-III is preferably 0.1 to 2.0 mols, and more preferably 0.15 to 1.5 mols per liter of a bleaching or bleach-fix solution.

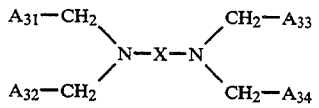

Formula A-IV wherein $A_{31}$ to $A_{34}$ may be either the same as or different from one another and each represent —$CH_2OH$, —COOM or —$PO_3M_1M_2$, wherein M, $M_1$ and $M_2$ each represent a hydrogen atom, an alkali metal atom or an ammonium group; and X represents a substituted or unsubstituted alkylene group having 3 to 6 carbon atoms.

Compounds represented by Formula A-IV are explained in detail.

Incidentally, details about $A_{31}$ to $A_{34}$ in Formula A-IV are omitted because they are as defined for the $A_1$ to $A_4$ described in Japanese Patent Application No. 260628/1989, p. 12–15.

Useful examples of the compound represented by Formula IV include the Compounds IV-1 to IV-12 listed in paragraph Nos. 0086 and 0087 of Japanese Patent Application No. 155617/1991.

As ferric complex salts of the above Compounds IV-1 to IV-12 there may be arbitrarily used the sodium salts, potassium salts or ammonium salts thereof. From the inventive effect and solubility points of view, the ferric ammonium salts of these compounds are suitably usable.

The particularly preferred among the above compounds are IV-1, IV-3, IV-4, IV-4 and IV-9. The most preferred is Compound IV-1.

Besides the above ferric complex salts of those compound represented by Formulas A-I to A-IV as bleaching agents to the bleaching or bleach-fix solution in the invention, ferric complex salts of the following compounds may also be used.

A'-1Ethylenediaminetetraacetic acid
A'-2 Trans-1,2-cyclohexandiaminetetraacetic acid
A'-3 Dihydroxyethylglycinic acid
A'-4 Ethylenediaminetetrakismethylenephosphonic acid
A'-5 Nitrilotrismethylenephosphonic acid
A'-6 Diethylenetriaminepentakismethylenephosphonic acid
A'-7 Diethylenetriaminepentaacetic acid
A'-8 Ethylenediaminediorthohydroxyphenylacetic acid
A'-9 Hydroxyethylethylenediaminetriacetic acid
A'-10 Ethylenediaminedipropionic acid
A'-11 Ethylenediaminediacetic acid
A'-12 Hydroxyethyliminodiacetic acid
A'-13 Nitrilotriacetic acid
A'-14 Nitrilotripropionic acid
A'-15 Triethylenetetraminehexaacetic acid
A'-16 Ethylenediaminetetrapropionic acid The adding amount of any one of the compounds of Formula IV and the above compounds A'-1 to —16 to the bleaching or bleach-fix solution is preferably 0.1 to 2.0 mols, and more preferably 0.15 to 1.5 mols/liter.

Incorporation of at least one of the imidazole and its derivatives described in JP O.P.I. No. 295258/1989 or of those compounds represented by the Formulas I to IX and the exemplified compounds therefor in the same publication into the bleaching, bleach-fix or fixing solution is very effective to accelerate the processing speed thereof.

In addition to the above accelerators there may also be used any one of compounds including the exemplified compounds described in JP O.P.I. No. 123459/1990, p. 51–115; the exemplified compounds described in JP O.P.I. No. 17445/1991, p. 22–25; and those compounds as described in JP O.P.I. Nos. 95630/1978 and 28426/1978.

The bleaching or bleach-fix solution may also contain a halide such as ammonium bromide, potassium bromide or sodium bromide; a brightening agent, a defoaming agent, and a surface active agent in addition to the above.

In the invention, a thiocyanate or a thiosulfate is suitably usable as the fixing agent for the fixing solution or bleach-fix solution. The thiocyanate content of the solution is preferably at least 0.1 mol/liter; for processing a color negative film, more preferably not less than 0.5 mol/liter and most preferably not less than 1.0 mol/liter. The thiosulfate content is preferably at least 0.2 mol/liter; for processing a color negative film, more preferably not less than 0.5 mol/liter. In the invention, the combined use of a thiocyanate and a thiosulfate can accomplish more effectively the object of the invention.

In the invention, the proportion of ammonium ions to the whole cations in the fixing or bleach-fix solution is preferably not more than 50 mol %.

In the invention, the fixing or bleach-fix solution may contain a single pH buffer or two or more different pH buffers in combination comprising various salts in addition to the fixing agent. Further, it is preferable for the fixing of bleach-fix solution to contain a good amount of rehalogenating agents including alkali halides or ammonium halides such as potassium bromide, sodium bromide, sodium chloride, ammonium bromide, and the like. Further, those compounds generally known as additives to ordinary fixing or bleach-fix baths, such as polyethylene oxides, may also be used arbitrarily.

To the fixing or bleach-fix solution the addition of one or some of those compounds represented by the following Formula FA and the exemplified compounds therefor described in JP O.P.I. No. 295258/1989 is suitable to not only make the inventive effect better but also enable to provide another effect that the fixing capacity-having processing solution, when used over a long period for processing limited quantities of light-sensitive materials, can effectively inhibit sludge from accumulating therein.

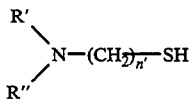

Formula FA

The compounds having Formula FA described in the same publication can be synthesized according to those common methods as described in U.S. Pat. Nos. 3,335,161 and 3,260,718. The compound of Formula FA may be used alone or in combination of two or more kinds thereof.

The compound having Formula FA provides good results when used in an adding amount of 1 g to 200 g per liter of the processing solution.

Next, solid photographic processing chemicals having a fixing capacity that are used in replenishing the above fixing or bleach-fix solution bath or added to an overflow from the stabilizer solution bath are explained. The above fixing capacity-having solid photographic processing chemicals are ones obtained by solidifying components substantially the same as or similar to those of the fixing or bleach-fix solution. The method for solidifying such chemicals is explained.

The 'solid photographic processing chemicals' is a general term for photographic processing chemicals of solid forms including not only those simply tabletted, granulated, powdered and massive forms but also those microcapsulated by being wrapped with alkali-soluble film, those wrapped with a water-soluble film, those dispersed or dissolved in a slight amount of solvent or water and microcapsulated or wrapped with a water-soluble film, and those in a liquid form (such as a solvent) but made into a capsulated form with a resin shell or a pasty form.

The solidification of photographic processing chemicals can be made by any arbitrary one of means including the kneading of a water-soluble binder with concentrated, powdered or granulated photographic-processing chemicals; the spray of a water-soluble binder material on the surface of provisionally formed photographic processing chemicals; and the like, as described in Japanese Patent Application Nos. 135887/1990, 203165/1990, 203166/1990, 203167/1990, 203168/1990 and 300409/1990.

Of the above solid forms of photographic processing chemicals the most preferred are tablets and granules for practicing the invention. Further, the processing chemicals' form of being packed, bound or covered with a water-soluble film or a binder is also preferred as well in the invention.

Tablets of processing chemicals can be produced by generally known methods as described in JP O.P.I. Nos. 61837/1976, 155038/1979 and 88025/1977, and British Patent No. 1,213,808; granules of the same by general methods as described in JP O.P.I. No. 109042/1990, 109043/1990, 39735/1991 and 39739/1991; and powder of the same by general methods as described in JP O.P.I. No. 133332/1979, British Patent Nos. 725,892 and 729,862, and German Patent No. 3,733,861.

The above tablet is one obtained by compressing powdery or grainy photographic processing chemicals into a small tabular or massive form, such as a lenticular, spherical, triangular, square, columnar or cyclindrical form, which is dissolved or collapsed in water or in a processing solution to thereby release a photographic processing composition. For example, a photographic processing chemicals composition is mixed with an excipient or binder to thereby make it in the form of powder, which is then made into tablets having a specified size and hardness by being subjected to compression tabletting machine treatment. Tabletted processing chemicals have the advantage that an accurate concentration of a processing solution can be easily prepared. The size of the tablet may be determined arbitrarily according to a desired embodiment for use.

The bulk density of the above solid processing chemicals is preferably 1.05 to 2.50 g/cm$^3$ and more preferably 1.2 to 2.0 g/cm$^3$ from the standpoint of the solubility thereof and the effect of accomplishing the invention.

In the invention, if part or the whole of the alkali agent, such as potassium carbonate, sodium carbonate, potassium hydroxide, potassium phosphate, potassium hydrogencarbonate or sodium hydroxide, contained in the solid photographic processing chemicals is covered with a water-soluble binder and packed with an internal packaging material, then the water-soluble film can be improved to be prevented from deterioration of its quality due to saponification by the alkali agent, and the effect of the invention is exhibited better.

Where the processing chemical is wrapped, bound or covered with a water-soluble film or a binder, the water-soluble film or binder used is preferably of a vinyl alocohol, methyl cellulose, polyethylene oxide, starch, polyvinylpyrrolidone, hydroxypropyl cellulose, pullulan, dextran, gum arabic, polyvinyl acetate, hydroxyethyl cellulose, carboxyethyl cellulose, sodium carboxymethylhydroxyethyl cellulose, poly(alkyl)oxazoline or polyethylene glycol compound. Of these, the polyvinyl alcohol and pullulan compounds are especially suitably usable from the viewpoint of the effect of the invention.

The suitable polyvinyl alcohol is a very good film-forming material because it shows good strength and elasticity under nearly every condition. Commercially available polyvinyl alcohol compositions for forming film have diverse molecular weights and hydrolyzed degrees, but the molecular weight range thereof is preferably 10000 to 100000. The hydrolyzed degree means the percentage of the hydroxyl-substituted acetate groups of polyvinyl alcohol. For the film formation, the applicable hydrolyzed range is normally about 70% to 100%. The term 'polyvinyl alcohol' includes usually vinyl acetate compounds.

The above water-soluble film can be produced according to any one of generally known methods as described in JP O.P.I. Nos. 124945/1990, 97348/1986, 158245/1985, 86638/1990, 117867/1982, 75650/1990, 226018/1984, 218741/1988 and 13565/1979.

As the water-soluble film there may be used commercially available products including Solublon, produced by AICELLO Chemical Co.; Hi-Selon, produced by NIPPON GOHSEI Ltd., and Pullulan, produced by Hayashibara Co. In addition, the 7000 series polyvinyl alcohol film, available from the MONO-SOL dept. of Chris Craft Industries Inc., is soluble in warm water at 34° F. to 200° F., harmless, and highly chemically resistant, and thus is most suitably usable.

The thickness of the above water-soluble film is preferably 10 to 120 μm, more preferably 15 to 80 μm, and most preferably 20 to 60 μm. If the thickness is less than 10 μm, it results in deterioration of the resulting solid photographic processing chemicals' preservability, while if it exceeds 120 μm, the water-soluble film takes too much time to dissolve to thus result in trouble of crystals deposition on the inside wall of the automatic processor.

The water-soluble film is preferably thermoplastic for not only facilitating its heat-sealing or supersonic welding treatment but for better achieving the object of the invention.

The tensile strength of the water-soluble film is preferably $0.5\times10^6$ to $50\times10^6$ kg/m$^2$, more preferably $1\times10^6$ to $25\times10^6$ kg/m$^2$, and most preferably $1.5\times10^6$ to $10\times10^6$ kg/m$^2$. The tensile strength is determined according to the method described in JIS-1521.

The solid photographic processing chemicals used in the invention may be provided in the form of either a kit of partitioned chemicals or solitary chemicals, and may also be provided by having a given amount of them extruded by a screw pump as in the case of granulated chemicals; thus the providing form of processing chemicals can be discretionarily selected as long as it does not affect the function of the invention.

The above solid photographic processing chemicals apply to fixing capacity-having chemicals, such as fixing chemicals or bleach-fix chemicals, and may also apply to other processing chemicals, such as the color developer, black-and-white developer, bleacher and stabilizer which will be explained hereinafter. The 'other processing chemicals' may be in a liquid state; hereinafter also called merely 'chemicals,' which will include those in a liquid state.

A preferred example of the processing solution used in the process that follows the above-mentioned fixing capacity-having processing solution is a stabilizer solution.

Next, the stabilizer solution is explained.

The stabilizer solution may be of a single bath, but is preferably of an increased number of baths, e.g., from two to around 10 baths; increasing the number of its baths largely affects the effect of the invention, and the bath increase within this range is suitable. Supply of a replenisher to the stabilizer solution may be made from some separate positions, but is preferably made to the rear bath downstream in the light-sensitive material processing line with a system in which an overflow (including the solution flow in the case where the solution is allowed to circulate through an interbath connection pipe) from the rear bath is made flow into the preceding bath. More preferably, two or more stabilizer solution baths are provided in which a stabilizer replenisher is supplied to the final bath thereof to have an overflow therefrom flow into the preceding bath to then have an overflow therefrom again in sequence flow into the further preceding bath . . . thus finally having an overflow therefrom flow into the fixing capacity-having solution bath, whereby the effect of the invention can be exhibited better. As the case may be, an overflow from an intermediate bath between the first stabilizer bath and the final stabilizer bath may be allowed to flow into the fixing capacity-having processing solution bath.

In the invention, the overflow from the stabilizer solution is let flow into the fixing capacity-having processing solution instead of being thrown into the discard, thereby making the waste amount of the stabilizer solution nil or very slight for overall waste amount reduction and at the same time necessitating little or no replenishment of water to the fixing capacity-having processing solution bath for overall water consumption reduction.

In the processing method of the invention, that the fixing capacity-having solid photographic processing chemicals are added to the overflow from the stabilizer solution bath to allow the overflow into the fixing capacity-having processing solution bath means more particularly a method in which the fixing capacity-having solid photographic processing chemicals are added to the overflow in the midst of running through piping from the stabilizer bath to the fixing or bleach-fix bath; a method in which the overflow from the stabilizer bath is once stored in a reservoir, and the fixing capacity-having solid photographic processing chemicals are added to the flow in running by pumping through piping to and from the reservoir; a method in which the overflow is once stored in a dissolution bath such as a mixing tank, and to the tank the above solid processing chemicals are added to be dissolved to prepare a replenisher to be flowed into the fixing or bleach-fix bath; and so forth.

Where the solid photographic processing chemicals are added to the overflow running through piping or added to a reservoir before flowing to the fixing or bleach-fix bath, it is preferable for the solid processing chemicals to have been completely dissolved at the point of time when the flow reaches the fixing capacity-having solution bath.

Alternatively, in the processing method of the invention, the stabilizer solution may be allowed to overflow directly into the fixing capacity-having processing solution bath; more in detail, the overflow is flowed through piping or stored in a reservoir and then pumped into the fixing capacity-having solution bath.

The fixing capacity-having solid photographic processing chemicals may be added to the fixing capacity-having photographic processing solution bath; to be concrete, the solid photographic processing chemicals, instead of being added to an overflow from the bath, are directly added to the bath or to a filter bath therefor.

In the invention, in any of the above procedures, the stabilizer solution preferably does substantially not contain formaldehyde. That the stabilizer solution does substantially not contain formaldehyde implies that the formaldehyde content of the stabilizer solution is zero up to 0.2 g.

The replenishing amount to the stabilizer solution depends on the construction of its bath; as the number of baths increases, the replenishing amount can be decreased. The pH range of the stabilizer solution is preferably 5.5 to 11.0, more preferably 7 to 10.5 and most preferably 7.5 to 10 from the viewpoint of accelerating the effect of the invention. The temperature of the stabilizer solution when used is preferably in the range of 15° C. to 70° C., and more preferably 20° C. to 55° C. The processing time in the stabilizer solution is preferably not longer than 120 seconds, more preferably 3 to 90 seconds and most preferably 6 to 60 seconds.

In the invention, it is preferable for the stabilizer solution to contain a chelating agent having a chelate stability constant of 8 to ferric ions, wherein the chelate stability constant means one of generally known constants by L. G. Sillen/A. E. Martell, 'Stability Constants of Metal-ion complexes', The Chemical Society, London (1964); and S. Chaberek/A. E. Martell, 'Organic Sequestering Agents', Wiley (1959).

Examples of the chelating agent having a chelate stability constant of 8 to ferric ions include those described in Japanese Patent Application Nos. 234776/1990 and 324507/1989.

The using amount of the above chelating agent is preferably 0.01 to 50 g, and more preferably 0.05 to 20 g per liter of the stabilizer solution.

A suitable compound as an additive to the stabilizer bath is an ammonium compound, which is provided in the form of one of ammonium salts of various inorganic compounds. The adding amount of the ammonium compound is preferably 0.001 mol to 1.0 mol, and more preferably 0.002 to 2.0 mols per liter of the stabilizer solution. The stabilizer solution preferably also contains a sulfite, and further preferably contains a metallic salt in combination with the foregoing chelating agent. The metallic salt includes salts of such metals as Ba, Ca, Ce, Co, In, La, Mn, Ni, Bi, Pb, Sn, Zn, Ti, Zr, Mg, Al and Sr. The above may be provided in the form of an inorganic salt such as a halide, hydroxide, sulfate, carbonate, phosphate or acetate, or in the form of a water-soluble chelating agent; the using amount thereof is preferably $1\times10^{-4}$ to $1\times10^{-1}$ mol, and more preferably $4\times10^{-4}$ to $2\times10^{-2}$ mol.

To the stabilizer solution may be added an organic acid salt such as a citrate, acetate, succinate, oxalate or benzoate; a pH adjusting agent such as a phosphate, borate, hydrochloride or sulfate. In addition, known fungicides may be used alone or in combination to an extent not to impair the effect of the invention.

The stabilizer solution used in the invention preferably contains a compound represented by the following formula I.

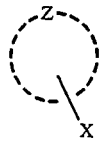

Formula I wherein Z represents a group of atoms necessary to form a substituted or unsubstituted aromatic heterocyclic ring; and X represents an aldehyde group,

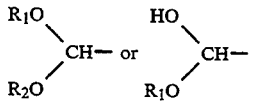

wherein $R_1$ and $R_2$ each represent a lower alkyl group.

Next, the compound represented by Formula I used in the invention is explained.

In Formula I, Z is a group of atoms necessary to form a substituted or unsubstituted carbocyclic or heterocyclic single or condensed ring, and is preferably a substituent-having aromatic carbocyclic or heterocyclic ring, wherein the substituent is preferably an aldehyde group, a hydroxy group; an alkyl group such as methyl, ethyl, methoxyethyl, benzyl, carboxymethyl or sulfopropyl; an aralkyl group; an alkoxy group such as methoxy, ethoxy or methoxyethoxy; a halogen atom, a nitro group, a sulfo group, a carboxy group; an amino group such as N,N-dimethylamino, N-ethylamino or N-phenylamino; a hydroxyalkyl group; an aryl group such as phenyl, p-methoxyphenyl; a cyano group; an aryloxy group such as phenoxy, p-carboxyphenyl; an acyloxy group, an acylamino group, a sulfonamido group; a sulfamoyl group such as N-ethylsulfamoyl, N,N-diemthylsulfamoyl; a carbamoyl group such as carbamoyl, N-methylcarbamoyl, N,N-tetramethylenecarbamoyl; or a sulfonyl group such as methanesulfonyl, ethanesulfonyl, benzenesulfonyl or p-toluenesulfonyl.

The carbocyclic ring represented by Z is preferably a benzene ring. The heterocyclic ring represented by Z is preferably a 5- or 6-member heterocyclic group, wherein the 5-member heterocyclic group is, e.g., thienyl, pyrrolyl, furyl, thiazolyl, imidazolyl, pyrazolyl, succinimido, triazolyl or tetrazolyl, while the 6-member heterocyclic group is pyridyl, pyrimidinyl, triazinyl or thiadiazinyl. The condensed ring is naphthalene, benzofuran, indolo thionaphthalene, benzimidazolyl, benaotriazolyl or quinolyl.

The following are exemplified compounds of Formula I

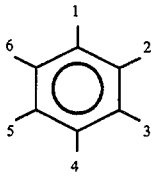

Exemplified Compounds 1 to 48 are obtained by applying the following listed substituents relevant to the above numbers 1 to6.

TABLE 1

| No. | 1 | 2 | 3 | 4 | 5 | 6 |
|---|---|---|---|---|---|---|
| (1) | CHO | H | H | H | H | H |
| (2) | CHO | H | H | OH | H | H |
| (3) | CHO | H | OH | H | H | H |
| (4) | CHO | OH | H | H | H | H |
| (5) | CHO | OH | H | OH | H | H |
| (6) | CHO | H | OH | H | OH | H |
| (7) | CHO | OH | OH | H | H | H |
| (8) | CHO | H | CHO | H | OH | H |
| (9) | CHO | H | CHO | H | H | OH |
| (10) | CHO | OH | CHO | H | H | H |
| (11) | CHO | H | CHO | H | CHO | H |
| (12) | CHO | OH | CHO | H | CHO | H |
| (13) | $CH(OCH_3)_2$ | H | OH | H | H | H |
| (14) | $CH(OCH_3)_2$ | H | H | OH | H | H |
| (15) | $CH(OCH_3)_2$ | H | OH | H | OH | H |
| (16) | CHO | H | $NO_2$ | H | H | H |
| (17) | CHO | H | H | $NO_2$ | H | H |
| (18) | CHO | $NO_2$ | H | H | H | H |
| (19) | CHO | H | $NO_2$ | H | $NO_2$ | H |
| (20) | CHO | H | H | $OCH_3$ | H | H |
| (21) | CHO | H | $OCH_3$ | H | OH | H |
| (22) | CHO | H | OH | $OCH_3$ | H | H |
| (23) | CHO | H | $OCH_3$ | OH | H | H |
| (24) | CHO | H | OH | $OCH_3$ | OH | H |
| (25) | CHO | H | Cl | H | H | H |
| (26) | CHO | H | H | Cl | H | H |
| (27) | CHO | H | Cl | H | Cl | H |
| (28) | CHO | H | COOH | COOH | H | H |
| (29) | CHO | H | Br | H | H | H |
| (30) | CHO | H | H | Br | H | H |
| (31) | CHO | H | OH | $SO_3H$ | H | H |
| (32) | CHO | H | H | $NH_2$ | H | H |
| (33) | CHO | H | H | $N(CH_3)_2$ | H | H |
| (34) | CHO | H | H | $N(C_2H_5)_2$ | H | H |
| (35) | CHO | H | H | $CONH_2$ | H | H |
| (36) | CHO | H | H | $SO_2NH_2$ | H | H |
| (37) | CHO | H | H | $SO_3H$ | H | H |
| (38) | CHO | H | H | CN | H | H |
| (39) | CHO | H | H | $COOCH_3$ | H | H |
| (40) | CHO | H | H | COOH | H | H |
| (41) | CHO | H | $SO_3H$ | H | H | H |
| (42) | CHO | H | COOH | H | H | H |
| (43) | CHO | H | CN | H | H | H |
| (44) | CHO | H | $COOCH_3$ | H | H | H |
| (45) | CHO | H | $CONH_2$ | H | H | H |
| (46) | $CH(OH)(OCH_3)$ | H | OH | H | H | H |
| (47) | $CH(OH)(OCH_3)$ | H | H | OH | H | H |
| (48) | CHO | H | OH | $CH_3$ | H | H |

(49)

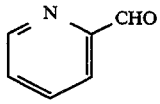

(50)

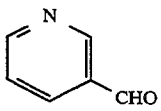

(51) (52)

TABLE 1-continued
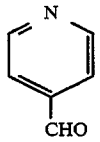
(53)
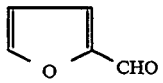
(54)
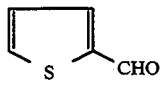
(55)
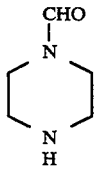
(56)
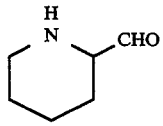
(57)
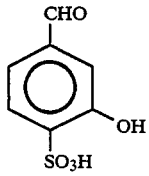
(58)
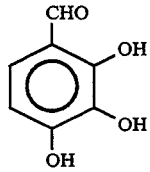
(59)
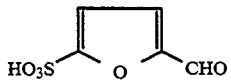
(60)
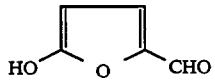
(61)
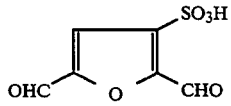
(62)
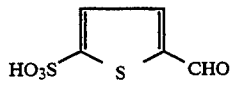
(63)
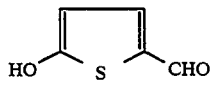
(64)
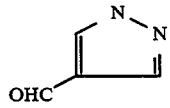
(65)
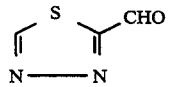
(66)
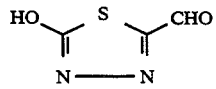
(67)
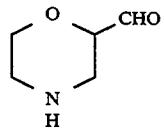
(68)
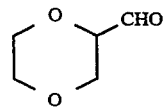
(69)
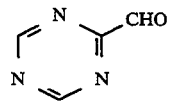
(70)

TABLE 1-continued
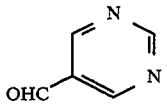
(71)
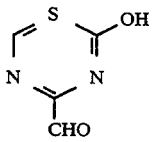
(72)
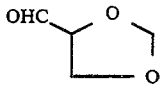
(73)
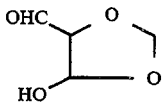
(74)
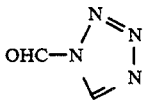
(75)
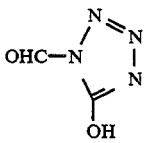
(76)
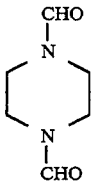
(77)
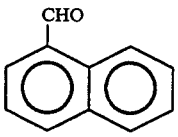
(78)
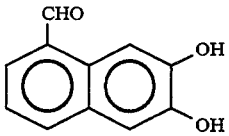
(79)
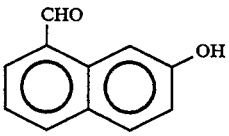
(80)
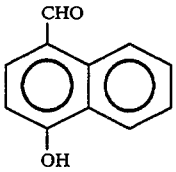
(81)
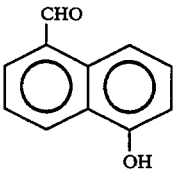
(82)
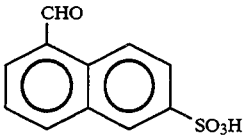
(83)
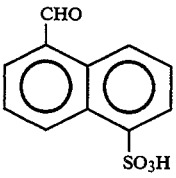
(84)
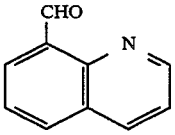
(85)
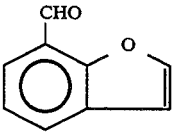
(86)

TABLE 1-continued

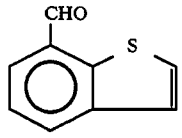

(87)

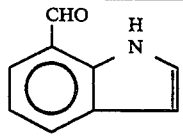

(88)

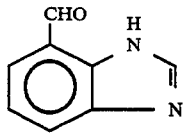

(89)

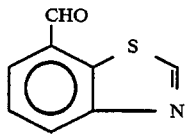

(90)

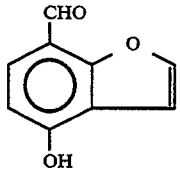

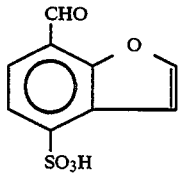

The above compounds represented by Formula I are easily commercially available as well.

The adding amount of the compound represented by Formula I is preferably 0.05 to 20 g, more preferably 0.1 to 15 g and most preferably 0.5 to 10 g per liter of the stabilizer solution.

The compound of Formula I is characterized by its capability of keeping image preservability better even under an extremely low humidity condition than known compounds substitute for aldehyde.

Subsequently, the light-sensitive material to which the processing method of the invention is applicable is explained.

Where the light-sensitive material is for camera use, the silver halide grains used therefor is preferably silver iodobromide or silver iodochloride grains having an average silver iodide content of not less than 6 mol %, and more preferably silver iodobromide containing silver iodide of 6 mol % to 15 mol %. Especially, the most preferred average silver iodide content for the invention is from 8 mol % to 11 mol %.

Silver halide -emulsions usable for the light-sensitive material to be processed in the processing method of the invention are described in Research Disclosure (hereinafter abbreviated to RD) 308119, in which the relevant sections are as follows.

| Item | Page/section RD308119 |
|---|---|
| Iodide compositions | 993 I-A |
| Manufacturing methods | 993 I-A and 994 E |
| Crystal habit: | |
| regular crystals | 993 I-A |
| twin crystals | " |
| Epitaxial | " |
| Halide compositions: | |
| homogeneous | 993 I-B |
| heterogenous | " |
| Halogen conversion | 994 I-C |
| Halogen substitution | " |
| Metals contained | 994 I-D |
| Monodispersibility | 995 I-F |
| Addition of solvents | " |
| Latent image forming positions: | |
| surface | 995 I-G |
| inside | " |

-continued

| Item | Page/section RD308119 |
|---|---|
| Applicable light-sensitive materials: | 995 I-H |
| negative | " |
| positive (containing internally fogged grains) | 995 I-J |
| Use of a mixture of emulsions | 995 I-J |
| Desalting | 995 II-A |

The silver halide emulsion is subjected to physical ripening, chemical ripening and spectral sensitization treatments. Useful additives for such treatments are described in RD17463, RD18716 and RD308119, in which the relevant sections thereto are as follows:

| Item | RD308119 | RD17643 | RD18716 |
|---|---|---|---|
| Chemical sensitizers | 996 III-A, | 23 | 648 |
| Spectral sensitizers | 996 IV-A-A,B,C,D,E,H,I,J | 23–24 | 648–9 |
| Supersensitizers | 996 IV-A-E,J | 23–24 | 648–9 |
| Antifoggants | 998 VI | 24–25 | 649 |
| Stabilizers | 998 VI | 24–25 | 649 |

Photographic additives also are described in the above RD publications, in which the sections relevant thereto are as follows:

| Item | RD308119 | RD17643 | RD18716 |
|---|---|---|---|
| Anticolor-cross-over agents | 1002 VII-I | 25 | 650 |
| Dye image stabilizers | 1001 VII-J | 25 | |
| Brightening agents | 998 V | 24 | |
| UV absorbents | 1003 VIII C, XIII C | 25–26 | |
| Light absorbents | 1003 VIII | 25–26 | |
| Light scattering agents | 1003 VIII | | |
| Filter dyes | 1003 VIII | 25–26 | |
| Binders | 1003 IX | 26 | 651 |
| Antistatic agents | 1006 XIII | 27 | 650 |
| Hardening agents | 1004 X | 26 | 651 |
| Plasticizers | 1006 XII | 27 | 650 |
| Lubricants | 1006 XII | 27 | 650 |
| Activators, coating aids | 1005 XI | 26–27 | 650 |
| Matting agents | 1007 X VI | | |
| Developing agents in | 1011 XX-B | | |

-continued

| Item | RD308119 | RD17643 | RD18716 |
|---|---|---|---|
| emulsion | | | |

The light-sensitive material to be processed in the processing method of the invention may contain various couplers. Examples of such couplers are described in the above RD numbers, in which the sections relevant thereto are as follows:

| Item | RD308119 | RD17643 | RD18716 |
|---|---|---|---|
| Yellow couplers | 1001 VII-D | VII C-G | |
| Magenta couplers | 1001 VII-D | VII C-G | |
| Cyan couplers | 1001 VII-D | VII C-G | |
| DIR couplers | 1001 VII-F | VII F | |
| BAR couplers | 1002 VII-F | | |
| Other useful residue-releasing couplers | 1001 VII-F | | |
| Alkali-soluble couplers | 1001 VII-E | | |

The above additives can be added according to the dispersion method described in RD308119 XIV.

The light-sensitive material to be processed by the processing method of the invention may have a support that is described in p. 28 of the aforementioned RD17643, pp. 647–648 of RD18716, or XIX of RD308119.

The light-sensitive material may have auxiliary layers such as filter layers, intermediate layers, etc., as described in RD308119, VII-K. The light-sensitive material may take various layer structures, such as normal layer structure, inverted layer struction and unit layer structure, as described in RD308119, VII-K.

Light-sensitive materials used as color photographic paper suitably processable in the processing method of the invention are explained.

The silver halide grains for the emulsion of the light-sensitive material is a silver chloride-rich silver halide of which the silver chloride content of preferably not less than 90 mol %, more preferably not less than 95 mol %, and most preferably not less than 99 mol %.

The above silver chloride-rich silver halide emulsion may contain silver bromide and/or silver iodide besides silver chloride. In this instant, the silver bromide content is preferably not more than 20 mol %, more preferably not more than 10 mol % and most preferably not more than 3 mol %. If silver iodide is present, its content is preferably not more than 1 mol %, more preferably not more than 0.5 mol %, and most preferably zero. Such the silver chloride-rich silver halide comprising silver chloride in not less than 50 mol % is applied to at least one silver halide emulsion layer, and preferably applied to overall light-sensitive silver halide emulsion layers.

The grain crystal of the above silver halide may be either a regular crystal or twin crystal, and may have an arbitrary [1.0.0]face/[1.1.1]face proportion. The silver halide grain's crystal structure may be either overall uniform or non-uniform with difference in composition between the inside phase and the outside phase thereof (core/shell type). In addition, the silver halide grain may be of either the type of forming a latent image mainly on the grain surface or the type of forming a latent image mainly inside the grain. Tabular silver halide grains as described in JP O.P.I. No. 113934/1983 and Japanese Patent Application No. 170070/1984 may also be used. Further, those silver halide grains as described in JP O.P.I. Nos. 26837/1989, 26838/1989 and 77047/1984 may be used as well.

Where the light-sensitive material to be processed in the processing method of the invention is for color photography, the light-sensitive material contains color-forming couplers in its silver halide emulsion layers.

The red-sensitive silver halide emulsion layer of the above light-sensitive material may contain a nondiffusible phenol or α-naphthol coupler for forming a cyan dye image. The green-sensitive silver halide emulsion layer may contain at least one nondiffusible coupler such as 5-pyrazolone or pyrazolotriazole coupler for forming a magenta dye image. And the blue-sensitive silver halide emulsion layer may contain at least one nondiffusible coupler having an open-chain ketomethylene group for forming a yellow dye image. These couplers may be 6-, 4- or 2-equivalent couplers.

Especially, 2-equivalent couplers are suitable for the color light-sensitive material to be processed in the processing method of the invention.

Appropriate couplers are disclosed in, e.g., the following publications: W. Pelz, 'Farbkuppler' in Mitteilunglnausden Forschungslaboratorien der Agfa, Leverkusen/Munchen, vol. III, p. 111 (1961); K. Venkataraman, The Chemistry of Synthetic Dyes, vol. 4, pp. 341–387, Academic Press, The Theory of the Photographic Process, 4th ed. pp. 353–362; and Research Disclosure No. 17643, sec. VII.

In the color light-sensitive material to be processed in the processing method of the invention, from the viewpoint of making the most of the effect of the invention, it is preferred to use specially those magenta couplers represented by Formula M-I described in p. 26 and exemplified magenta couplers No. 1 to No. 77 described in p. 29–34 of JP O.P.I. No. 106655/1988; those cyan couplers represented by Formulas C-I and C-II described in p. 34 and exemplified cyan couplers Nos. C'-1 to C'-82 and C''-1 to C''-36 described in p. 37–42 of the same publication; and those high-speed yellow couplers described in p. 20 and exemplified yellow couplers Nos. Y'-1 to Y'-39 described in p. 21–26 of the same publication.

Automatic processors to which the processing method of the invention is applicable are not particularly restricted, but are preferably those as described in Japanese Patent Application No. 141425/1991.

An example of the automatic processor applicable to the invention (hereinafter merely called the automatic processor) is explained by making reference to the attached drawings.

Figure 1:
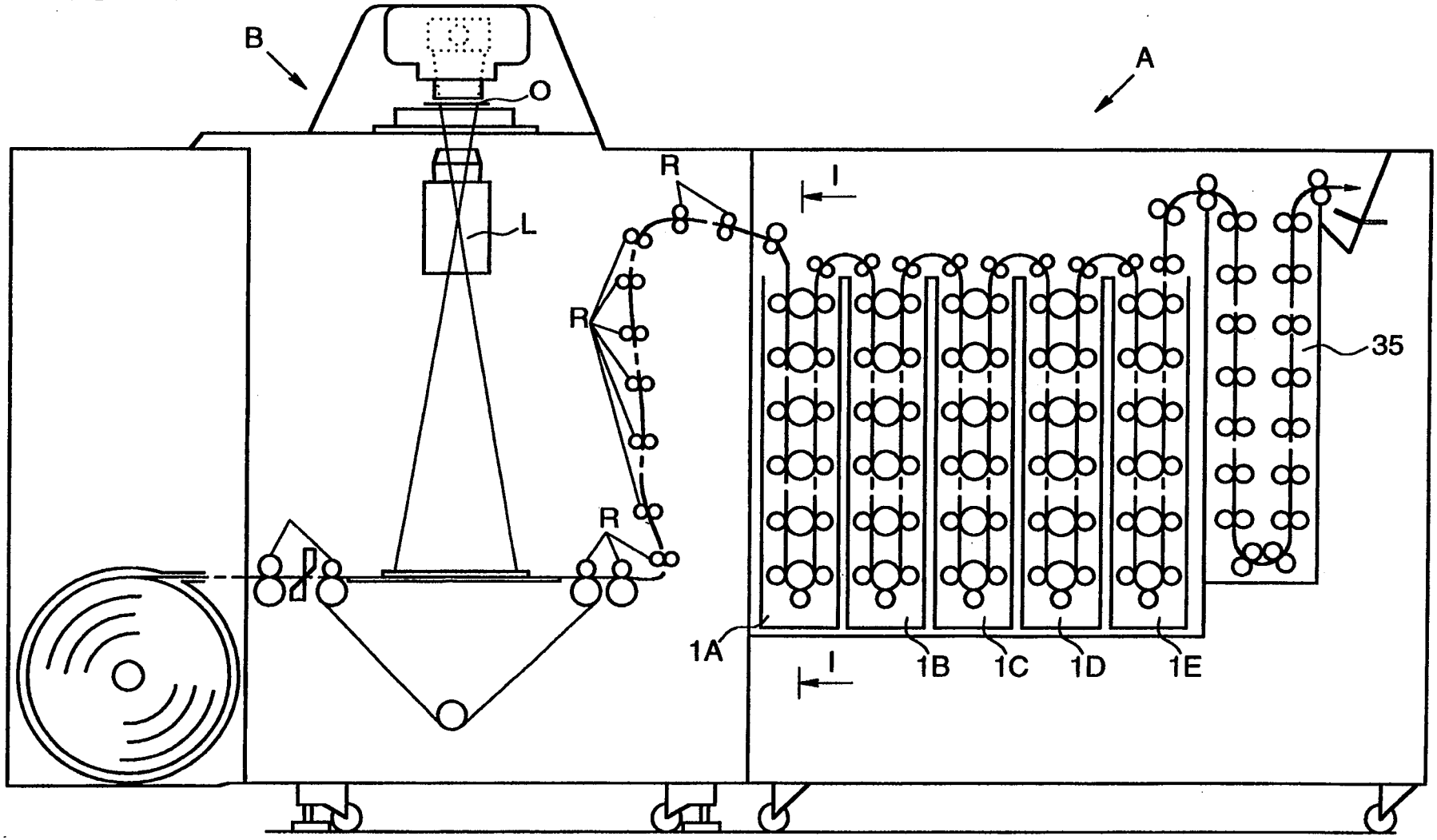
FIG. 1 is a schematic drawing of a printer/processor comprised integrally of an automatic processor and a photographic printer.

FIG. 1 is a schematic drawing showing a printer processor integrally comprised of autoprocessor A and photographic printer B.

In FIG. 1, photographic printer B has a magazine M set in its lower left part, said magazine holding an unexposed photographic paper in roll, a silver halide photographic light-sensitive material. The photographic paper drawn out of the magazine is sent through feed roller R to cutter section C to be cut into specified size sheets. The photographic paper sheets are then transported by belt transport means B to exposure section E, in which the paper sheet is exposed to original image 0. The imagewise exposed paper sheet is further transported by rollers R thereby to be conducted into automatic processor A, in which the paper sheet is transported in sequence through color developer bath 1A, bleach-fix bath 1B, stabilizing baths 1C, 1D and 1E by roller transport means (with no reference symbols)

thereby to be subjected to color developing, bleach-fix and stabilizing treatments, respectively. The photographic paper sheet thus processed in the above baths is then dried in drying section 35, and after that it is ejected from the machine.

In the drawing, the long-and-short-dash line indicates the transport path of the silver halide photographic light-sensitive material. In the present example, the light-sensitive material is conducted, in the cut state, into automatic processor A, but may also be conducted, in the web roll state, into the autoprocessor. In this instance, an accumulater where the light-sensitive material is allowed to stay temporarily may be provided between autoprocessor A and photographic printer B in order to raise the processing efficiency. It goes without saying that the automatic processor according to the invention may be either integrated with or independent of photographic printer B. It is needless to say that the silver halide photographic light-sensitive material to be processed in the automatic processor of the invention is not limited to an exposed photographic paper alone, but may also be an exposed negative film and the like. As an explanation of the invention, description is hereinafter made on an automatic processor comprised substantially of three baths: a color developer bath, a bleach-fix bath and a stabilizing bath, but the automatic processor according to the invention is not limited to this, but may also be one comprised substantially of four baths: a color developer bath, a bleaching bath, a fixing bath and a stabilizing bath.

Figure 2:
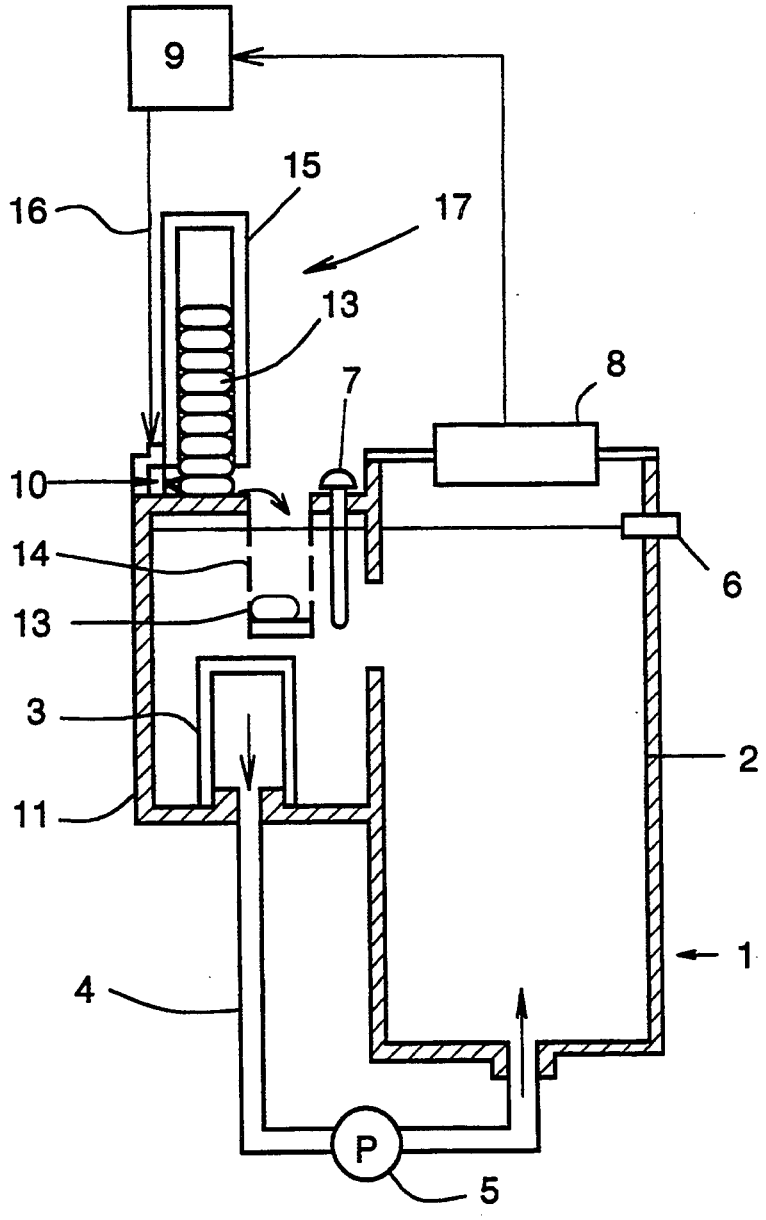
FIG. 2 is a cross-sectional view of the processing chemicals introducing section and processing chemicals supply means of the automatic processor.

FIG. 2 is a schematic drawing of color developer bath [A, a cross-sectional view of the processing bath as seen in the direction of arrows from the line I—I of FIG. 1. In bleach-fix bath 1B and stabilizing baths 1C, 1D and 1E, the structure thereof is the same as that of color developer bath 1A, so that when explained as processing bath 1, it includes any of the color developer bath 1A, bleach-fix bath 1B, and stabilizing baths 1C, 1B and 1E.

In the drawing, in order to make the structure comprehensible, light-sensitive material transport means are omitted. In the present example, explanation is made concerning the instance where thirteen tablets are used as the solid processing chemicals.

Processing bath 1 has a processing section 2 for processing a light-sensitive material and a solid processing chemicals introducing section 11 for supplying tablets 13, said section 11 being integrally provided on the outside of the partition wall that forms said processing section 2. These processing section 2 and solid processing chemicals introducing section 11 are divided by a partition wall with a circulation opening, through which the processing solution can circulate. The introducing section 11 is provided with a receptor 14 to hold solid processing chemicals, so that the processing chemicals can not move in the solid state therefrom to processing section 12.

Cylindrical filter 3 is interchangeably provided at the bottom of the solid processing chemicals introducing section 11, and functions to remove insoluble foreign matter such as trash from the processing solution. The inside of the filter is connected through a circulation pipe 4 that is provided piercing the lower wall of solid processing chemicals introducing section 11 to the sucking side of a circulation pump 5 (circulation means).

The circulation system comprises circulation pipe 4, circulation pump 5 and processing bath 1, which constitute the circulation path for the processing solution. The other end of circulation pipe 4, which connects to the discharge side of the foregoing circulation pump 5, pierces the lower wall of processing section 2 and connects to the processing section 2. In the above construction, if circulation pump 5 works, the processing solution is sucked from solid processing chemicals introducing section 11 and discharged to processing section 2 to have the processing solution mixed with the processing solution inside processing section 2 and again returns to the solid processing chemicals introducing section 11, thus repeating the circulation. The flow rate of the circulation flow is preferably not less than 0.1 revolution (revolution=circulation amount/tank capacity), and more preferably 0.5 to 2.0 revolutions per minute to the tank capacity. The circulation direction of the processing solution is not limited to the direction indicated in FIG. 2, but may be in the opposite direction.

Discharge pipe 6 is for overflowing the processing solution inside processing .section 2 and serves to maintain its liquid level constant by temporarily reserving the constituents carried in from other processing baths by or oozes out of the light-sensitive material to prevent the solution from increasing.

Rod heater 7 is arranged so as to pierce the upper wall Of solid processing chemicals introducing section 11 to be dipped in the processing solution inside the solid processing chemicals introducing section 11. The heater 7 is a temperature adjusting means to warm the processing solution inside processing bath 1 to keept its temperature in the range of, e.g., 20° to 55° C.

Processing quantity information detection means 8 is provided at the inlet of the automatic processor, and used to detect what quantities of light-sensitive materials have been processed. The processing quantity information detection means 8 have a plurality of detection members arranged on both left and right sides of the processor to function as an element for detecting the width of the light-sensitive material to be processed and at the same time for counting the detecting period of time. Since the light-sensitive material's transport speed is in advance mechanically set, the light-sensitive material's processed area can be calculated from both the width information and the time information.

The processing quantity information detection means is one such as an infrared sensor, microswitch, ultrasonic sensor, etc., that can detect the width and transport time of the light-sensitive material, or one that can indirectly detect the processing area of the light-sensitive material, which, in the case of the printer processor as shown in FIG. 1, may be one capable of counting the number of printing or processing light-sensitive material sheets each having an in advance determined area.

As for the detection timing, in this example the detection is made prior to processing, but may be made after processing or during the time when the light-sensitive material is immersed in the processing solution. (In this instance, the position of detection means 8 may be arbitrarily changed to a place where detection can be made after or during processing.) Further, as the information to be detected the processing area of the light-sensitive material has been mentioned in the above explanation, but not limited thereto. The information may be values corresponding to quantities of the light-sensitive material that is going to be processed, that has been processed or that is in processing, or else may be the concentration or changes in the concentration of the processing solution held in the processing bath. The processing quantity information detection means 8 need not be provided one for each of the processing baths 1A, 1B, 1C, 1D and 1E; one detection means is enought for one automatic processor.

A processing chemicals supply means 17 for introducing solid processing chemicals held in cartridge 15 into the processing bath is arranged above filter section 14, and has a cartridge 15 containing processing chemicals tablets 13 and an extrusion member 10 of a structure to extrude one tablet or a number of tablets out of the tablets 13. The processing chemicals supply means 17 is controlled by a hereinafter described processing chemicals supply control means 9. Interlocking with the supply signal from the processing chemicals supply control means 9, the processing chemicals supply means 17 lets the extrusion member 10 extrude the tablets 15 on standby to thereby supply the tablets 13 to filter section 14 inside solid processing chemicals introducing section 11.

In the invention, solid processing chemicals 13 are supplied to filter section 14 inside solid processing chemicals receptor 11, but the place to which they should be supplied may be at any point as long as it is within processing bath 1. Namely, in the invention, solid processing chemicals need only be dissoled by use of a processing solution; i.e., it is required that the constituents according to the processing information of the light-sensitive material be securely introduced to keep constant the processing characteristics of the processing solution inside processing bath 1, and it is more preferred that solid processing chemicals be supplied into the processing solution circulate path. The processing chemicals supply means 17 is preferably arranged so as not to bring the solid processing chemicals before being supplied to the processing bath into contact with the moisture inside and outside the processing baths of the automatic processor and splash from the processing solution.

Filter means 14 is dipped in the processing solution inside the solid processing chemicals introducing section 11, and serves to remove the insoluble matter attributable to the tablets 13 supplied by processing chemicals supply means 17, such as, e.g., insoluble components mixed in tablets 13, fragmented lumps of collapsed tablets 19, and the like, which, if attached to the light-sensitive material in processing, damages the resulting image 12 or causes the attached portions to look under developed. The filter means 14 is made of a resin. It is not essential to provide filter means 14 inside the solid processing chemicals introducing means 11; what is important is that tablets 13 supplied by the processing chemicals supply means 17 be cast into the light-sensitive material's transport path or into the processing solution inside processing section 2.

Processing chemicals supply control means 9 controls the processing chemicals supply means 17. When the light-sensitive material's processing quantity information (processing area in this example) detected by processing quantity information detection means 8 reaches a specified value, the supply control means 9 gives a processing chemicals supply signal to the processing chemicals supply means 17. The processing chemicals supply control means 9 controls the supply means 17 so as to supply a necessary amount of processing chemicals according to the processing quantity information to the solid processing chemicals introducing section 11.

Next, the operation of the invention is explained by making reference to FIG. 2. As for the exposed light-sensitive material, its processing quantity information is detected at the inlet of the automatic processor by processing quantity information detection means 8. Processing chemicals supply control means 9 gives a supply signal to processing chemicals supply means 17 when the accumulated area of the processed light-sensitive materials reaches the specified area limit according to the processing quantity information that has been detected by processing quantity information detection means 8. The processing chemicals supply means 17, which has received the supply signal, has the extrusion member 10 extrude tablets 13 to supply the tablets to filter means 14 inside the solid processing chemicals introducing section 11. The supplied tablets 13 are dissolved by the processing solution inside the solid processing chemicals introducing section 11, and further its dissolution is accelerated by the processing solution being circulated by a circulating means through an endless cycle formed as solid processing chemicals introducing section 11→circulation pump 5→processing section 2→circulation opening→solid processing chemicals introducing section.

On the other hand, the detected light-sensitive material is transported by roller transport means sequentially through color developer bath 1A, bleach-fix bath 1B, stabilizing baths 1C, 1D and 1E (see automatic processor A of FIG. 1). Color developer bath 1A, bleach-fix bath 1B, and stabilizing baths 1C, 1D and 1E may have their own respective processing chemicals supply means 17 to supply the respective chemicals at the same time. The chemicals supply timing may vary from supply means to supply means, and further it is needless to say that the specified area for which the processing chemicals supply means is controlled by processing chemicals supply control means 9 may be either common to or different between the processing baths 1A, 1B, 1C, 1D and 1E.

In not only the above example but the example to be explained below, bleach-fix bath 1B and stabilizing baths 1C, 1D and 1E each are of the same structure as that of color developer bath 1A, so that when explained as processing bath 1, it means any of the above baths. And in the drawing, to those parts having the same functions as in FIG. 2 the same notational numbers and symbols will apply, so, hereinafter explanations about them will be omitted. Further, in order to make the structure conprehensible, the light-sensitive material's transport means will not be described. In addition, in the present example, the filter means was described as a preferred example, but in the invention, even if there is no filter means, the effect of the invention can be sufficiently exhibited.

As has been explained above, according to the invention, the conventionally required replenishing tank is unnecessary. Since there is no need of securing a space therefor, the automatic processor can be made more compact. Because solid processing chemicals are supplied to processing baths, no processing solution preparation work is required. The solid processing chemicals get rid of concern about trouble of splash attaching to or staining the operator's body and clothes, and peripheral equipment, and are easy to handle. Further the use of solid processing chemicals exhibits excellent effects that it enables to increase the precision of replenishing the processing solution as well as to lessen the degradation of processing solution's constituents, thus leading to obtaining more stabilized processing characteristics.

Figure 3:
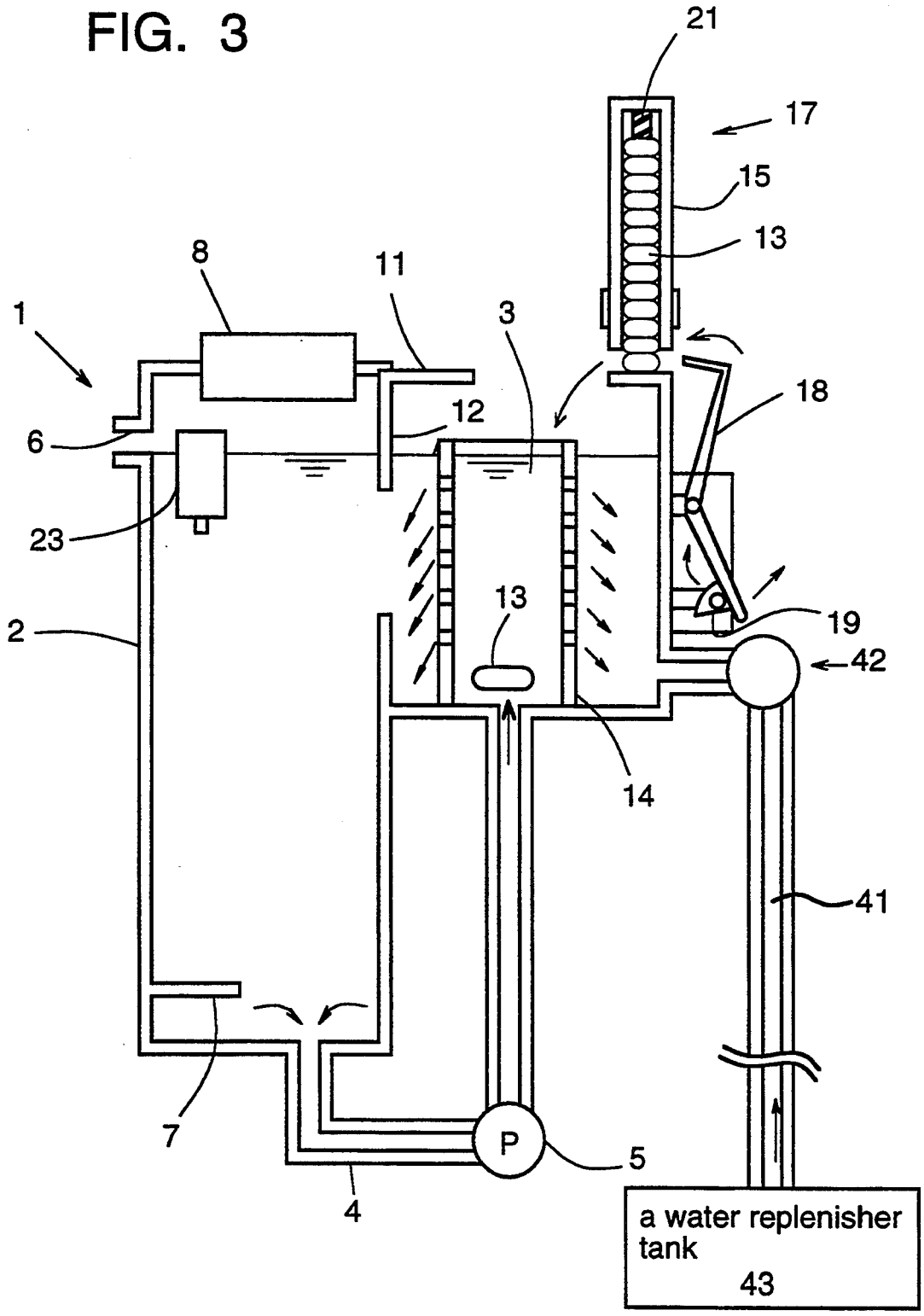
FIG. 3 is a cross-sectional view of the processing chemicals introducing section and processing chemicals supply means supplemented with a water-replenishing means.
Figure 4:
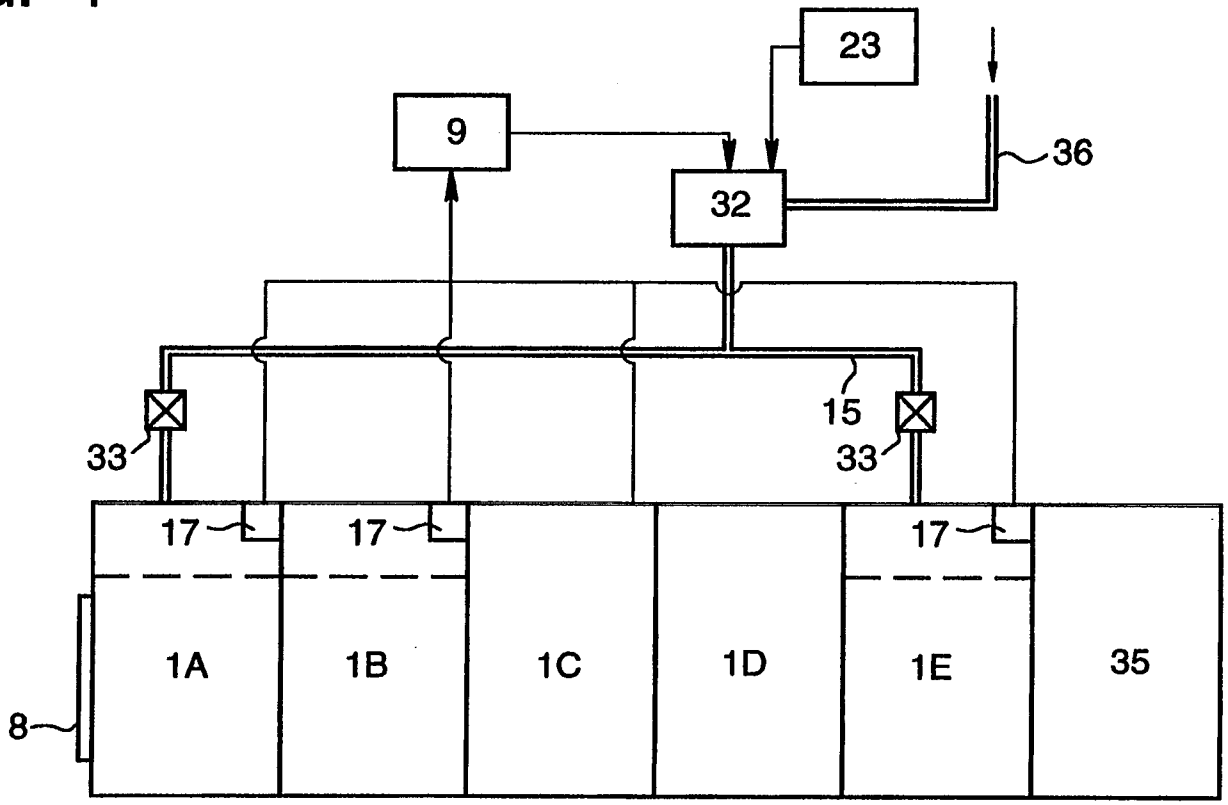
FIG. 4 is a plan view of the automatic processor.
Figure 5:
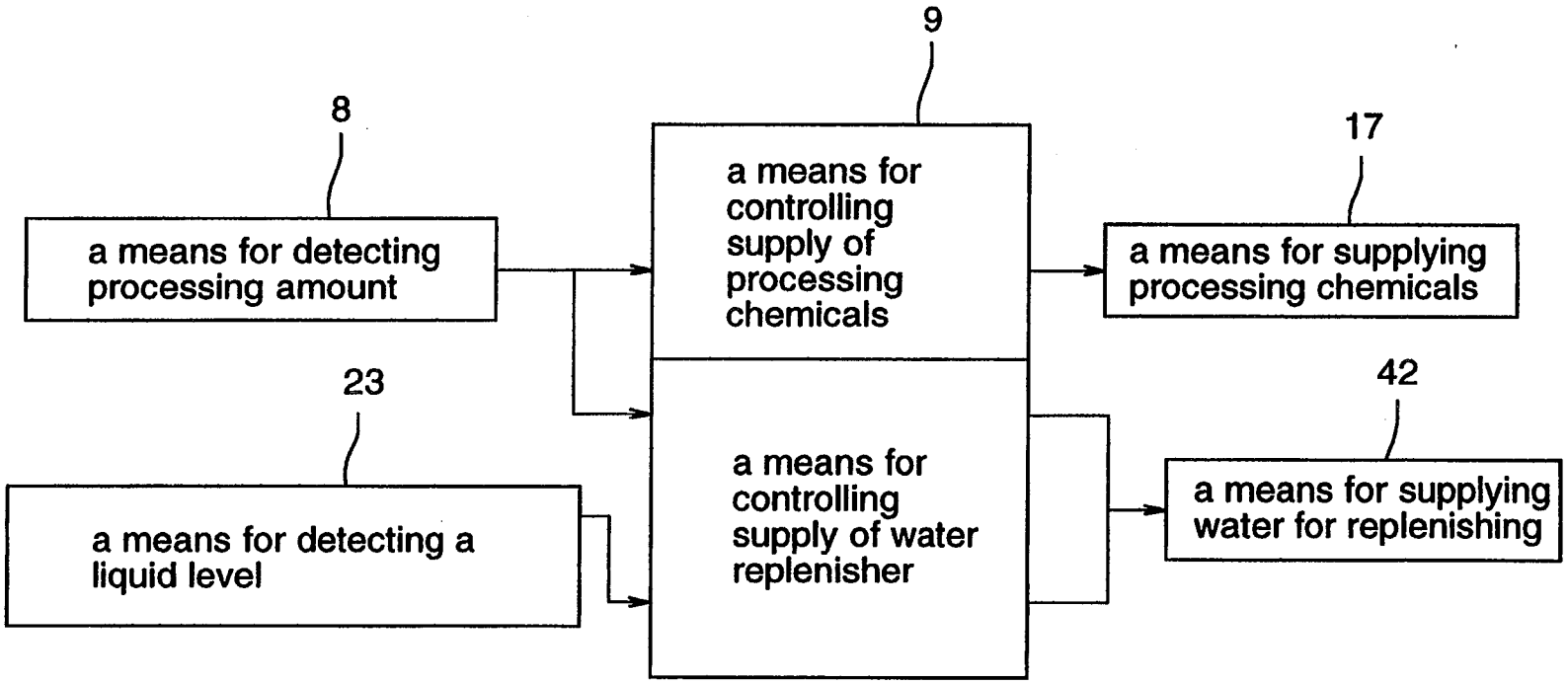
FIG. 5 is a block diagram of the automatic processor including control means.
Figure 6:
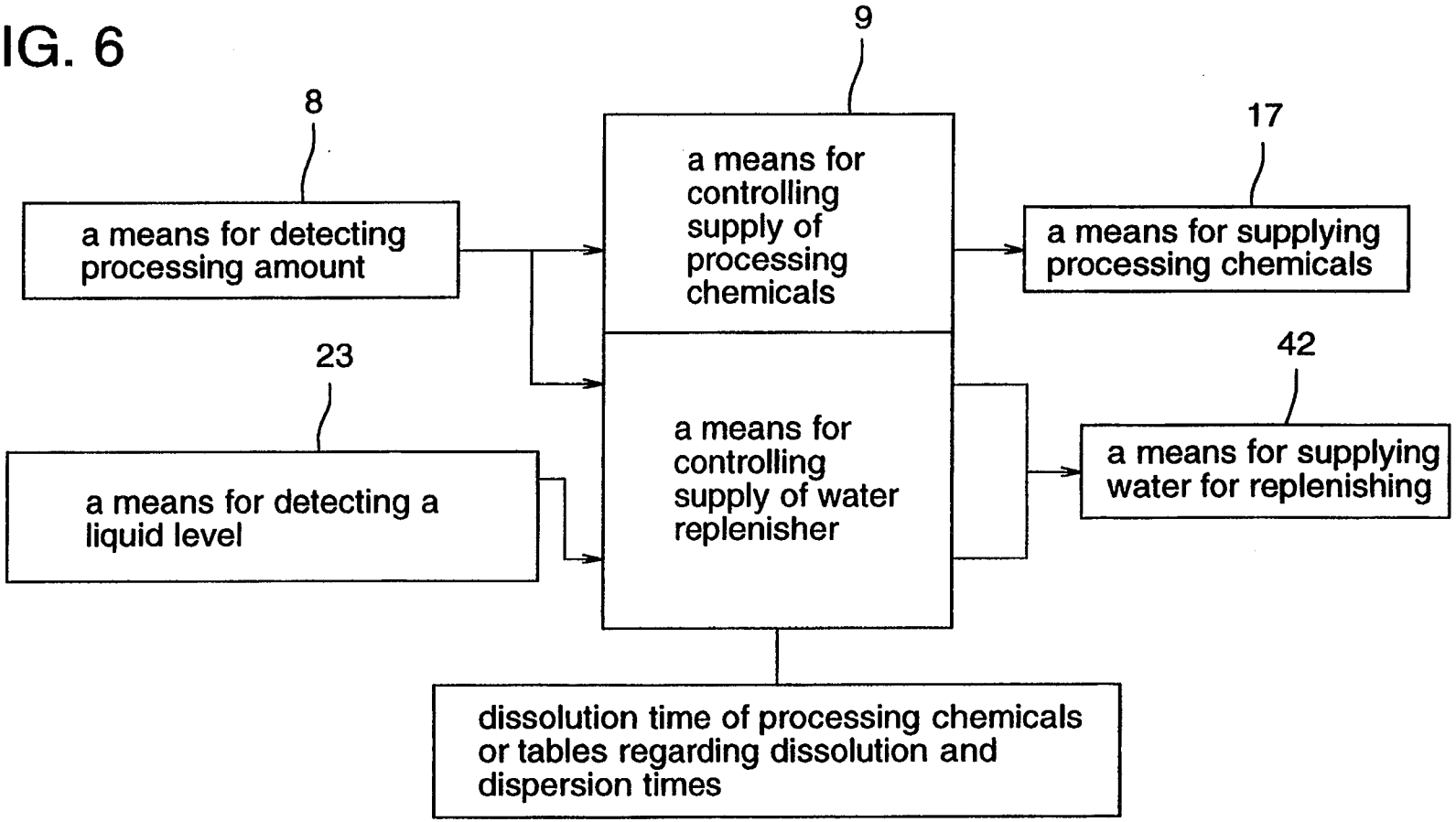
FIG. 6 is a block diagram of the same supplemented with tables regarding dissolution.

As another example of the invention FIG. 3 is a schematic cross-sectional view of color developer bath 1A as seen in the direction of arrows from the line I—I of FIG. 1; a replenishing water supply means-supplemented cross-sectional view of the processing chemicals introducing section and processing chemicals supply means. FIG. 4 is a schematic plan view of automatic processor A of FIG. 10 provided that a water replenishing route is described for convenience of explanation). FIG. 5 is a block diagram relating to control system in the invention. FIG. 6 is a block diagram of the control system supplemented with a preprogramed means 23 for replenishing the water shortage by evaporation.

In addition, in FIG. 3 and FIG. 4 a replenishing water tank 43, a reservoir for replenishing water, are shown. In this example, explanation is made concerning the case where tablets are used as the solid processing chemicals 13.

In FIG. 3 and FIG. 4, only parts different from those of FIG. 2 are explained.

Replenishing water supply means 42 is a means for providing replenishing water from water reservoir tank 43 to the processing chemicals introducing section 11, and comprises a warm water supply device 32 consisting of a pump and a heater, an electromagnetic valve 33 and a water supply pipe 36. The replenishing water supply means 42 serves to dilute the concentration of accumulated restraining components eluted by the reaction from the light-sensitive material in processing as well as to make up for the loss of water carried out by the light-sensitive material and by evaporation from the surface of the processing solution bath. Processing baths 1A, 1B, 1C, 1D and 1E may have their own respective replenishing water tanks and pumps, but if the same water in one single replenishing tank is used in common to all the baths, the automatic processor can be more compact, and more preferably the automatic processor can be made still more compact if one single water replenishing tank with a single replenishing pump alone is provided thereto with its supply route (piping) having electromagnetic valves equipped on its way so as to supply a necessary amount of water when necessary or with its supply piping having its diameter adjustable to properly control the supply amount. Regarding the stabilizing baths 1C and 1D, by supplying the overflowed stabilizing solution from the stabilizing baths 1D and 1E thereto, the replenishing water supply means can be omitted. In the invention, by supplying the stabilizing solution overflowed from stabilizing bath 1C to bleach-fix bath 1B, the replenishing water supply means to bleach-fix bath 1B can also be omitted.

These effects remarkably appear when the solid processing chemicals supply means of the invention is used.

The overflow to bleach-fix bath 1B may be that from 1D and 1E, and in 1D, the overflow is divided as a diluted solution and a concentrated solution by using a reverse osmotic membrane, and the diluted solution can be supplied to stabilizing bath 1E and the concentrated solution can be partially or wholy supplied to bleach-fix bath 1B. When the overflow is supplied to bleach-fix bath 1B, the flow by a metering pump such as a bellows pump or due to a head can be used. In a word, any means may be used as long as it is useful for accomplishing the effect and-object of the invention.

In the case of the automatic processor for color film processing, there are instances different in the bath arrangement such as:

color developer bath→bleach-fix bath→fixing bath→stabilizing bath, color developer bath→bleaching bath→bleach-fix bath→fixing bath→stabilizing bath, color developer bath→bleaching bath→bleach-fix bath→stabilizing bath.

In the case of color developer bath→bleaching bath→fixing bath→stabilizing bath, there are two ways of overflowing: from the stabilizing bath to the fixing bath and bleaching bath, and from the bleaching bath to fixing bath, more preferably from the stabilizing bath to the fixing bath.

In the case of color developer bath→bleaching bath→bleach-fix bath→fixing bath→stabilizing bath, there are some ways of overflowing: from the bleaching bath or from the fixing bath to the bleach-fix bath, and from the stabilizing bath to all of or part of the bleaching bath, bleach-fix bath and stabilizing bath.

In the case of color developer bath→bleaching bath→bleach-fix bath→stabilizing bath, the stabilizing bath may overflow to the bleaching bath and/or bleach-fix bath. And it is preferable that water of the replenishing water tank be properly heated. The water to be supplied may be not only ordinary water such as well water and city water but also one containing a fungicide such as an isothiazoline compound or chlorine-releasing compound; a sulfite or a chelating agent; ammonia or inorganic salt, and other compounds known to be photographically safe.

The replenishing water control means is a control means to control the replenishing water supply means 42 according to the preprogramed evaporation replenishing water setting means 23 and/or to control the replenishing water supply means 42 according to the processing quantity information detected by the processing quantity information detection means 8. The replenishing water supply means may carry out its control operation not only according to the processing quantity information detected by processing quantity information detection means 8 but also according to the information telling that the processing chemicals have been supplied by processing chemicals supply means 17.

The different sections between FIG. 3 and FIG. 2, except what have been described above, are the same in the function as in FIG. 2, and they will be explained below:

Heater 7 is arranged in the lower part of processing section 2 to heat the processing solution inside the processing section 2. In other words, it has a temperature control function to keep the processing solution inside the processing section 2 and solid processing chemicals introducing section 11 at a suitable temperature range (e.g., 20° to 55° C.).

As the circulation means, circulation pipe 4 and circulation pump 5 are provided in the same way as in FIG. 2, but what is different from FIG. 2 is that the processing solution circulates in the opposite direction; i.e., processing section 2→circulation pump 5→solid processing chemicals introducing section 11→circulation opening→processing section 2.

Processing chemicals supply means 17 serves to let claw 18 extrude solid processing chemicals tablets 13 held inside a cartridge 15 to thereby supply them to the filter means inside the solid processing chemicals introducing section What is different from FIG. 2 is that cam 19 is operated by a one axis revolution stop mechanism to let the push claw 18 work to cast tablet 13 on standby into processing bath 1. Then the subsequent tablet 13 quickly comes on standby since it is resiliently biased downward by a tablet-pushing spring 21. In this instance, the processing chemicals supply means 17 may turn sideways or may also turn upside down so as to push the tablet upward. In a word, the means need only be one capable of introducing tablets into processing bath 1.

Subsequently, the operation of the invention is explained by making reference to FIGS. 1, 3, 4 and 5. As for the exposed light-sensitive material, its processing quantity information is detected by the processing quantity detection means 8 at the inlet of the automatic processor A.

Processing chemicals supply control means 9, when the accumulated area of the processed light-sensitive material reaches the specified area limit according to the processing quantity information detected by processing quantity information detection means 8, gives a supply signal to processing chemicals supply means 17. The processing chemicals supply means 17, which has received the supply signal, lets extrusion member 10 cast tablet 15 into filter means 14 inside the solid processing chemicals introducing section 11. The supplied tablet 13 dissolves in the processing solution inside the solid processing chemicals introducing section 11, and further its dissolution is accelerated by the processing solution being circulated by a circulation means through the route of processing section 2→circulation pump 5→solid processing chemicals introducing section 11→circulation opening→processing section 2.

On the other hand, the replenishing water supply means, when the accumulated area of the processed light-sensitive material reaches the specified area limit according to the processing quantity information detected by processing quantity information detection means 8, gives a water replenishing signal to replenishing water supply means 42 (comprising warm water supply device 32 and electromagnetic valve). The replenishing water supply means 42, which has received the signal, controls the warm water supply device 32 and electromagnetic valve 33 to supply a given amount or necessary amount of water from the replenishing water reservoir tank to each processing bath or to the processing bath that requires water. The specified area limit in this case is the same as that in the case of processing chemical supply control means 9, but may be determined otherwise without being limited thereto.

On the other hand, the light-sensitive material that has been detected is transported by roller transport means in sequence to be processed in color developer bath 1A, bleach-fix bath 1B, and stabilizing baths 1C, 1D and 1E.

As the method for supplying an overflow to different processing chemicals and different processing baths there are methods as shown in FIG. 7(A) and (B), but if its supply is possible otherwise, it is not restricted thereto.

FIG. 7(A) is a cross-sectional view of automatic processor A, wherein the oblique-lined sections represent processing solutions. The level of the surface of the solution (liquid level) varies from bath to bath; in contrast to the liquid level of bleach-fix bath 1B, those of stabilizing baths 1C, 1D and 1E are arranged in tiers to become higher in sequence. In this instance, any mechanical supply means such as a pump is unnecessary, so that it is considered a good example of the invention.

FIG. 7(B) indicates a method in which the overflow from bath 1C runs through pipe 100 and stored in stock tank 101, from which part of the overflow is flowed in a certain ratio thereto by pump 102 into stabilizing bath 1B.

EXAMPLES

EXAMPLE 1

Solid reprenisher chemicals used in the invention were prepared according to the following procedures:

1) Color developer replenisher for color negative film

Operation (A)

Sixty grams of hydroxylamine sulfate were pulverized in an air-jet pulverizer into powder having an average particle size of 10 μ. This powder was granulated by being sprayed at room temperature for 7 minutes with 3.0 ml of water in a commercially available fluid-bed spray granulator, and then the granulated product was dried for 8 minutes at an air temperature of 63° C., and further dried under vacuum at 40° C. for 90 minutes for almost complete dehydration.

Operation (B)

One hundred and twenty grams of a color developing agent CD-4[4-amino-3-methyl-N-ethyl-N-β-hydroxyethyl)aniline sulfate were pulverized by the air-jet pulverizer and then granulated in the same manner as in Operation (A) except that the amount of sprayed water was 2.6 ml and the granulated product was dried at 60° C. for 7 minutes. After that, it was again dried under vacuum at 40° C. for 90 minutes for almost complete dehydration.

Operation (C)

Fifty grams of trisodium 1-hydroxyethane-1,1-diphosphate, 35 g of sodium sulfite, 308 g of potassium carbonate, 15 g of sodium hydrogencarbonate and 7 g of sodium bromide were mixed uniformly by a commercially available mixer, and then pulverized by the air-jet pulverizer and granulated in the same manner as in Operation (A) except that the amount of sprayed water was 20 ml and the granulated product was dried at 70° C. for minutes. After that, it was again dried under vacuum at 40° C. for 90 minutes for almost complet dehydration.

Operation (D)

A mixture of 35 g of sodium sulfite, 40 g of sodium diethylenetriaminepentaacetate, 308 g of potassium carbonate, 15 g of sodium hydrogencarbonate and 7 g of sodium bromide was granulated in the same manner as in Operation (C) except that the sprayed amount of water was 20 ml and dried at 80° C. for 10 minutes.

Operation (E)

The granulated products obtained in the above Operations (A) through (D) were mixed uniformly by means of a mixer in a room air-conditioned at 25° C. with a relative humidity of not more than 40%. Then, the mixture was solidified by use of a Tough-Press Collect 1527HU-modified tabletting machine, manufactured by Kikusui Co., in which process 5.00 g of the above mixture were filled in the tabletting machine to form each tablet, thus repeating this operation step, whereby 200 color developer replenisher tablets for color negative film processing were produced from the mixture.

2) Bleaching bath replenisher

Operation (F)

A mixture of 900 g of ferric-potassium 1,3-propylenediaminetetraacetate, 200 g of ferric-sodium ethylenediaminetetraacetate, 25 g of sodium ethylenediaminetetraacetate and 25 g of sodium hydrogencarbonate was granulated in the same manner as in Operation (C) except that the sprayed amount of water was 60 ml and the granulated product was dried at 80° C. for one hour.

Operation (G)

A mixture of 1500 g of potassium bromide, 175 g of sodium nitrate, 144 g of maleic acid was granulated in the same manner as in Operation (C) except that the sprayed amount of water was 90 ml and the granulated product was dried at 77° C. for 6 hours.

Operation (H)

The granulated products produced by the above Operations (F) and (G) were mixed in the same manner as in Operation (E) and then solidified, and 500 bleacher replenisher tablets for color negative film processing were prepared from the mixture in the same manner as in Operation (E) except that the filling amount of the granules to the tabletting machine was 5.94 g.

3) Fixing bath replenisher

Operation (I)

A mixture of 600 g of ammonium thiosulfate, 100 g of sodium sulfite, 200 g of sodium thiosulfate, 10 g of sodium ethylenediaminetetraacetate and 10 g of sodium hydrogencarbonate was granulated in the same manner as in Operation (C) except that the sprayed amount of water was 55 ml and the granulated product was dried at 50° C. for 6 hours.

Operation (J)

The granulated product obtained in the above Operation (I) was tabletted in the same manner as in Operation (E) except that the filling amount to the tabletting machine was 7.36 g, whereby 125 fixer replenisher tablets for color negative film processing were produced.

4) Stabilizer replenisher

Operation (K)

A mixture of 24 g of the following compound, 0.6 g of 1,2-benzoisothiazoline-3-one, 15 g of hexamethylenetetramine, 20 g of polyvinyl pyrrolidone (polymerization degree: about 17) and 4 g of sodium hydrogencarbonate was pulverized in the same manner as in Operation (C). Granulation of the above product was further continued while being sprayed for 20 minutes with 6 g of the following compound at room temperature. After that, the granulated product was dried at 65° C. for 10 minutes, and further dried under vacuum at 40° C. for 90 minutes.

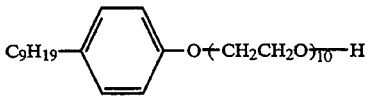

Operation (L)

The granulated product obtained in the above Operation (K) was tabletted in the same manner as in Operation (E) except that the filling amount to the tabletting machine was 0.3 g, whereby 70 stabilizer replenisher tablets for use in color negative film processing were prepared.

Subsequently, a color negative film sample for the invention was prepared as follows. The added amounts of the following components for the light-sensitive material sample are indicated in grams per $m^2$ unless otherwise stated except the silver halide and colloidal silver are indicated in silver equivalent.

One side (obverse side) of a triacetyl cellulose film support was subjected to subbing treatment, and then on the other side (reverse side), opposite to the subbed side, were formed the following layers in order from the support side.

| | |
|---|---|
| Layer 1 on the reverse side | |
| Aluminasol AS-100 (aluminum oxide) produced by Nissan Kagaku | 100 mg/$m^2$ |
| Diacetyl cellulose | 200 mg/$m^2$ |
| Layer 2 on the reverse side | |
| Diacetyl cellulose | 100 mg/$m^2$ |
| Stearic acid | 10 mg/$m^2$ |
| Silica fine particles (average particle diameter: 0.2 μm) | 50 mg/$m^2$ |

On the subbed obverse side of the support were formed the following layers in order from the support side, whereby a multilayer color photographic light-sensitive material (1) was prepared.

| | |
|---|---|
| Layer 1: Antihalation layer (HC) | |
| Black colloidal silver | 0.15 g |
| UV absorbent UV-1 | 0.20 g |
| Compound CC-1 | 0.02 g |
| High-boiling solvent Oil-1 | 0.20 g |
| High-boiling solvent Oil-2 | 0.20 g |
| Gelatin | 1.6 g |
| Layer 2: Intermediate layer (IL-1) | |
| Gelatin | 1.3 g |
| Layer 3: Low-speed red-sensitive emulsion layer (R-L) | |
| Silver iodobromide emulsion (average grain diameter: 0.3 μm, average silver iodide content: 2.0 mol %) | 0.4 g |
| Silver iodobromide emulsion (average grain diameter: 0.4 μm, average silver iodide content: 8.0 mol %) | 0.3 g |
| Sensitizing dye S-1 | $3.2 \times 10^{-4}$ mol/mol Ag |
| Sensitizing dye S-2 | $3.2 \times 10^{-4}$ mol/mol Ag |
| Sensitizing dye S-3 | $0.2 \times 10^{-4}$ mol/mol Ag |
| Cyan coupler C-1 | 0.50 g |
| Cyan coupler C-2 | 0.13 g |
| Colored cyan coupler CC-1 | 0.07 g |
| DIR compound D-1 | 0.006 g |
| DIR compound D-2 | 0.01 g |
| High-boiling solvent Oil-1 | 0.55 g |
| Gelatin | 1.0 g |
| Layer 4: High-speed red-sensitive emulsion layer (R-H) | |
| Silver iodobromide emulsion (average grain diameter: 0.7 μm, average silver iodide content: 7.5 mol %) | 0.9 g |
| Sensitizing dye S-1 | $1.7 \times 10^{-4}$ mol/mol Ag |
| Sensitizing dye S-2 | $1.6 \times 10^{-4}$ mol/mol Ag |
| Sensitizing dye S-3 | $0.1 \times 10^{-4}$ mol/mol Ag |
| Cyan coupler C-2 | 0.23 g |
| Colored cyan coupler CC-1 | 0.03 g |

-continued

| | |
|---|---|
| DIR compound D-2 | 0.02 g |
| High-boiling solvent Oil-1 | 0.25 g |
| Gelatin | 1.0 g |
| Layer 5: Intermediate layer (IL-2) | |
| Gelatin | 0.8 g |
| Layer 6: Low-speed green-sensitive emulsion layer (G-L) | |
| Silver iodobromide emulsion (average grain diameter: 0.4 μm, average silver iodide content: 8.0 mol %) | 0.6 g |
| Silver iodobromide emulsion (average grain diameter: 0.3 μm, average silver iodide content: 2.0 mol %) | 0.2 g |
| Sensitizing dye S-4 | $6.7 \times 10^{-4}$ mol/mol Ag |
| Sensitizing dye S-5 | $0.8 \times 10^{-4}$ mol/mol Ag |
| Magenta coupler M-1 | 0.17 g |
| Magenta coupler M-2 | 0.43 g |
| Colored magenta coupler CM-1 | 0.10 g |
| DIR compound D-3 | 0.02 g |
| High-boiling solvent Oil-2 | 0.7 g |
| Gelatin | 1.0 g |
| Layer 7: High-speed green-sensitive emulsion layer (G-H) | |
| Silver iodobromide emulsion (average grain diameter: 0.7 μm, average silver iodide content: 7.5 mol %) | 0.9 g |
| Sensitizing dye S-6 | $1.1 \times 10^{-4}$ mol/mol Ag |
| Sensitizing dye S-7 | $2.0 \times 10^{-4}$ mol/mol Ag |
| Sensitizing dye S-8 | $0.3 \times 10^{-4}$ mol/mol Ag |
| Magenta coupler M-1 | 0.30 g |
| Magenta coupler M-2 | 0.13 g |
| Colored magenta coupler CM-1 | 0.04 g |
| DIR compound D-3 | 0.004 g |
| High-boiling solvent Oil-2 | 0.35 g |
| Gelatin | 1.0 g |
| Layer 8: Yellow filter layer (YC) | |
| Yellow colloidal silver | 0.1 g |
| Additive HS-1 | 0.07 g |
| Additive HS-2 | 0.07 g |
| Additive SC-3 | 0.12 g |
| High-boiling solvent Oil-2 | 0.15 g |
| Gelatin | 1.0 g |
| Layer 9: Low-speed blue-sensitive emulsion layer (B-L) | |
| Silver iodobromide emulsion (average grain diameter: 0.3 μm, average silver iodide content: 2.0 mol %) | 0.25 g |
| Silver iodobromide emulsion (average grain diameter: 0.4 μm, average silver iodide content: 8.0 mol %) | 0.25 g |
| Sensitizing dye S-9 | $5.8 \times 10^{-4}$ mol/mol Ag |
| Yellow coupler Y-1 | 0.6 g |
| Yellow coupler Y-2 | 0.32 g |
| DIR compound D-1 | 0.003 g |
| DIR compound D-2 | 0.006 g |
| High-boiling solvent Oil-2 | 0.18 g |
| Gelatin | 1.3 g |
| Layer 10: High-speed blue-sensitive emulsion layer (B-H) | |
| Silver iodobromide emulsion (average grain diameter: 0.8 μm, average silver iodide content: 8.5 mol %) | 0.5 g |
| Sensitizing dye S-10 | $3 \times 10^{-4}$ mol/mol Ag |
| Sensitizing dye S-11 | $1.2 \times 10^{-4}$ mol/mol Ag |
| Yellow coupler Y-1 | 0.18 g |
| Yellow coupler Y-2 | 0.10 g |
| High-boiling solvent Oil-2 | 0.05 g |
| Gelatin | 1.0 g |
| Layer 11: First protective layer (PRO-1) | |
| Silver iodobromide (average grain diameter: 0.08 μm) | 0.3 g |
| UV absorbent UV-1 | 0.07 g |

-continued

| | |
|---|---|
| UV absorbent UV-2 | 0.10 g |
| Additive HS-1 | 0.2 g |
| Additive HS-2 | 0.1 g |
| High-boiling solvent oil-1 | 0.07 g |
| High-boiling solvent Oil-3 | 0.07 g |
| Gelatin | 0.8 g |
| Layer 12: Second protective layer (PRO-2) | |
| Compound A | 0.04 g |
| Compound B | 0.004 g |
| Polymethyl methacrylate (average particle size: 3 μm) | 0.02 g |
| Copolymer of methyl methacrylate:ethyl methacrylate: methacrylic acid = 3:3:4 (ratio by weight) (average particle size: 3 μm) | 0.13 g |

The silver iodobromide emulsion used in Layer 10 was prepared in the following manner:

Monodisperse silver iodobromide grains having an average grain diameter of 0.33 μm (silver iodide content: 2 mol %) were used as seed crystals to prepare a silver iodobromide emulsion therefrom according to a double-jet process.

Solution G-1 was kept at 70° C., pAg 7.8 and pH 7.0, and to the solution, with stirring well, was added a seed emulsion in a 0.34 mol equivalent amount.

Formation of Internal High-Iodide Phase: Core Phase

After that, Solutions H-1 and S-1 were added at an accelerating flow rate ratio of 1:1 (the final flow rate is 5.2 times the initial flow rate) spending 56 minutes.

During the grain formation, pAg and pH were controlled with use of a aqueous potassium bromide solution and an aqueous 56% acetic acid solution. The formed grains were washed according to the usual flocculation process, then redispersed by adding gelatin thereto, and its pH and pAg were adjusted at 40° C. to 5.8 and 8.06, respectively.

The obtained emulsion was a monodisperse emulsion containing octahedral silver iodobromide grains having an average grain diameter of 0.80 μm, a grain diameter distribution broadness of 12.4% and a silver iodide content of 8.5 mol %.

| | |
|---|---|
| Solution G-1 | |
| Osein gelatin | 100.0 g |
| Compound-I, 10 wt % methanol solution | 25.0 ml |
| 28% aqueous ammonia | 440.0 ml |
| Aqueous 56% acetic acid solution | 660.0 ml |
| Water to make | 5000.0 ml |

Compound-1

$$HO(CH_2CH_2O)_m(\overset{\overset{CH_3}{|}}{C}HCH_2O)_{17}(CH_2CH_2O)_nH$$

(Average molecular weight ≈ 1300)

| | |
|---|---|
| Solution H-1 | |
| Osein gelatin | 82.4 g |
| Potassium bromide | 151.6 g |
| Potassium iodide | 90.6 g |
| Water to make | 1030.5 ml |
| Solution S-1 | |
| Silver nitrate | 309.2 g |
| 28% aqueous ammonia | Equivalent |
| Water to make | 1030.5 ml |
| Solution H-2 | |
| Osein gelatin | 302.1 g |
| Potassium bromide | 770.0 g |
| Potassium iodide | 33.2 g |
| Water to make | 3776.8 ml |
| Solution S-2 | |

-continued

| | |
|---|---|
| Silver nitrate | 1133.0 g |
| 28% aqueous ammonia | Equivalent |
| Water to make | 3776.8 ml |

The foregoing other emulsions were also prepared in the same manner except that the average grain diameter of seed grains, temperature, pAgo pH, flow rate, adding time and halide compositions were appropriately changed.

The obtained emulsions were core/shell-type monodisperse emulsions each having a grain size distribution broadness of not more than 20%. Each emulsion was subjected to optimum chemical ripening treatment in the presence of sodium thiosulfate, chloroauric acid and ammonium thiocyanate; and to it were added appropriate spectral sensitizers, 4-hydroxy-6-methyl-13,3a,7-tetrazaindene and 1-phenyl-5-mercaptotetrazole.

C-1

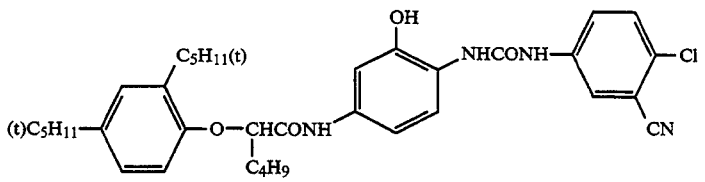

C-2

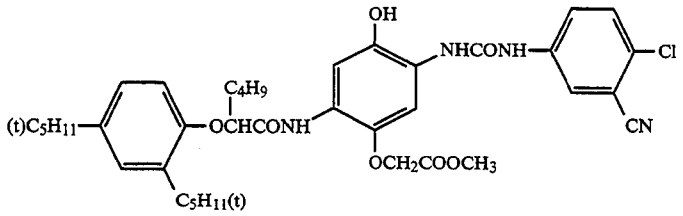

M-1

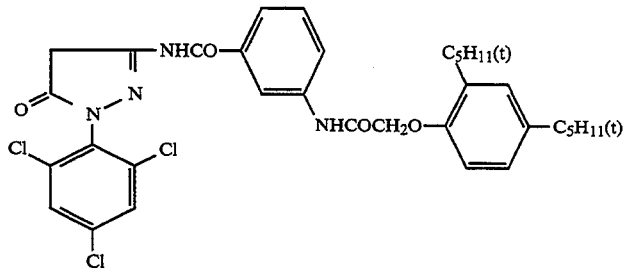

M-2

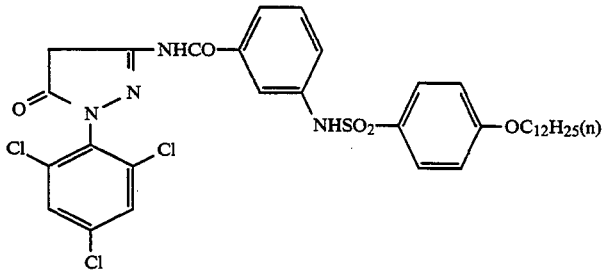

Y-1

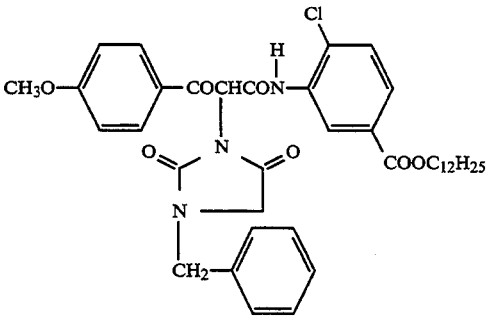

Y-2

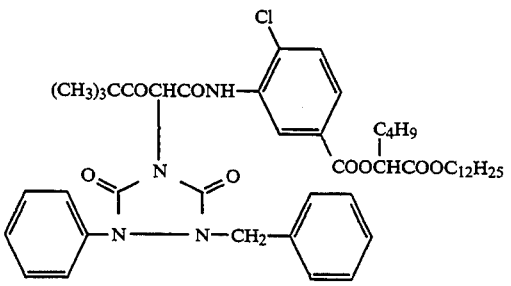

-continued
CC-1
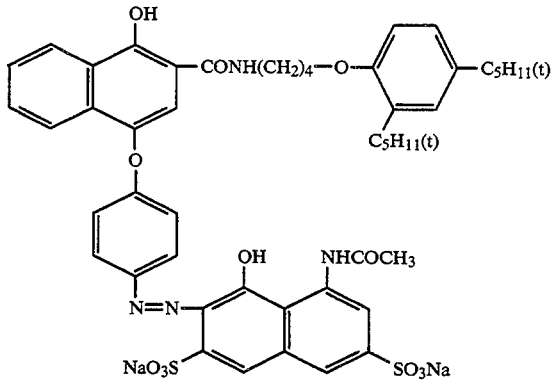
CM-1
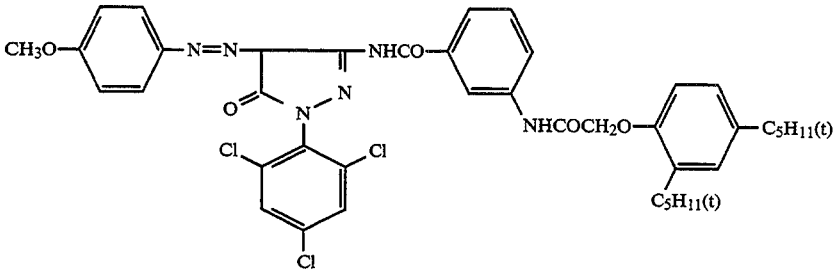
D-1
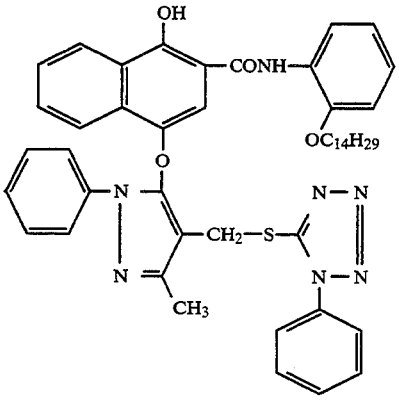
D-2
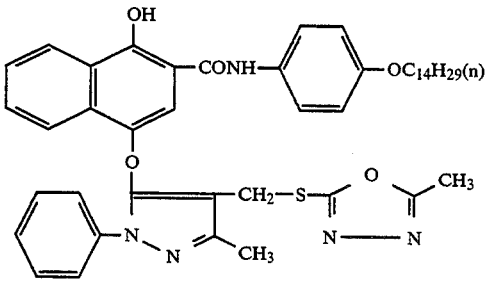
D-3
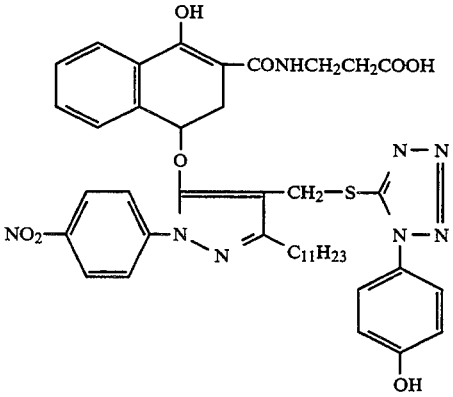
UV-1
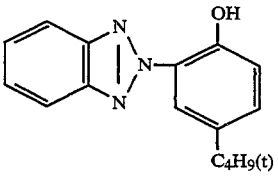
UV-2
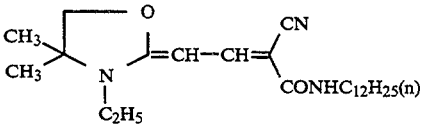
S-1
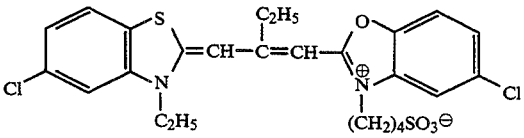

-continued
S-2
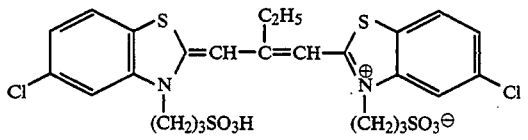
S-3
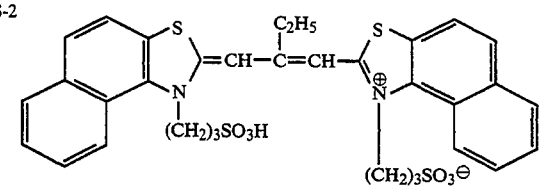
S-4
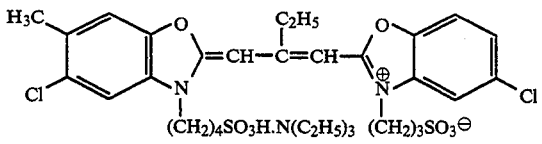
S-5
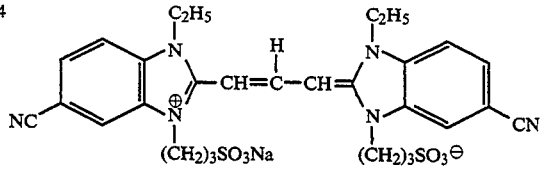
S-6
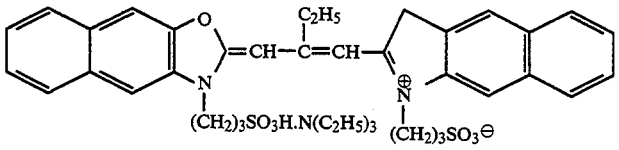
S-7
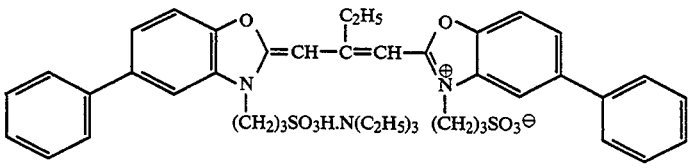
S-8
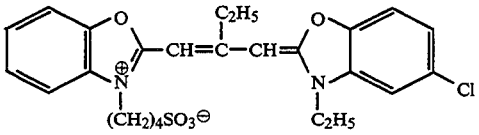
S-9
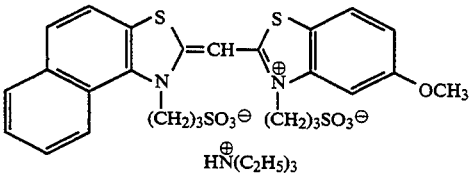
S-10
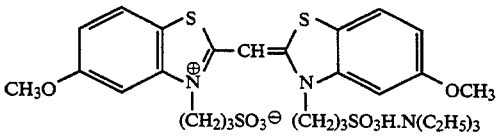
S-11
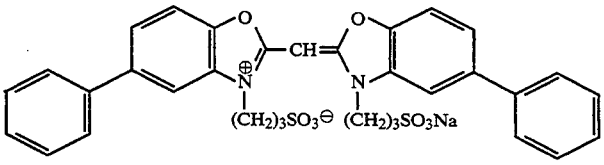
HS-1
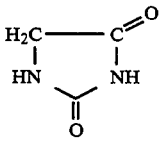
HS-2
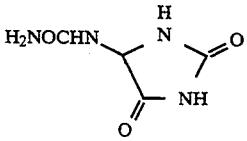
SC-1
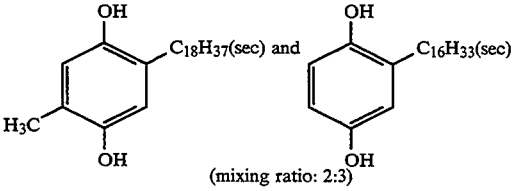
Oil-1
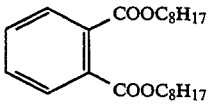

-continued

Oil-2

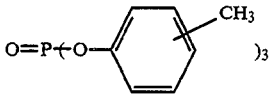

Oil-3

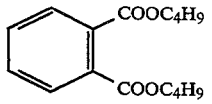

H-1

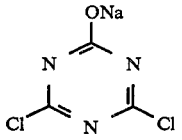

H-2

$(CH_2{=}CHSO_2CH_2)_2O$

SU-1

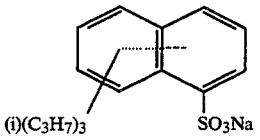

SU-2

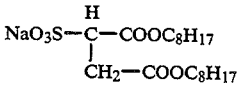

AI-1

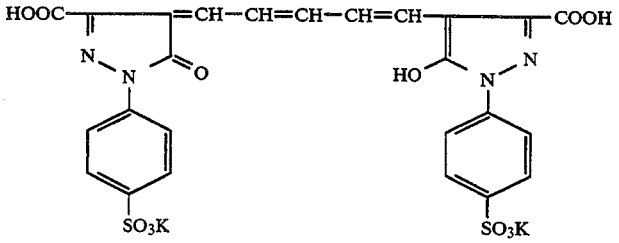

AI-2

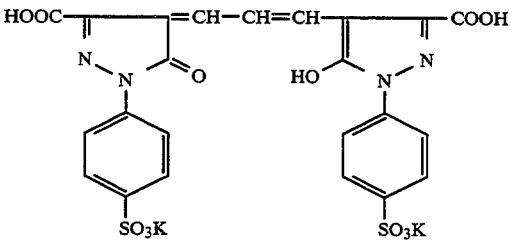

ST-1

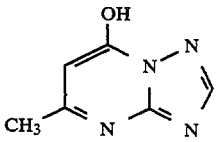

AF-1

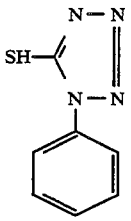

AF-2

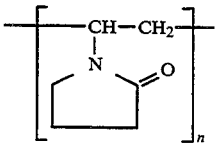

Compound A

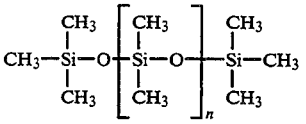

Weight average molecular weight = 30,000

Compound B

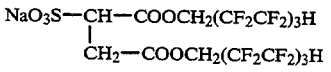

The above light-sensitive material (1) further contains compounds Su-1 and Su-2, viscosity adjusting agent, hardeners H-1 and H-2, stabilizing agent ST-1, antifoggants AF-1 and AF-2 having weight average molecular weight of 10,000 and 100,000, respectively, dyes AI-1 and AI-2, and compound DI-1 (9.4 mg/m$^2$).

DI-1 (a mixture of the following three constituents)

(A)

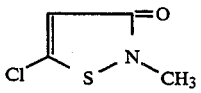

-continued (B)

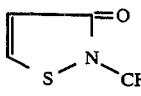

(C)

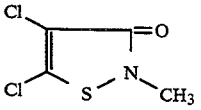

-continued
A:B:C = 50:46:4

The above prepared color negative film sample (135 size, for 24 exposures) was exposed through an wedge in the usual manner, and then subjected to continuous running processing by use of the foreoing solid processing chemicals in a KONICOLOR Negative Film Processor CL-KP-50QA modified-type automatic processor.

The following are the standard processing conditions for the automatic processor.

| Processing step | Temperature | Time |
|---|---|---|
| Color developing | 38.0 + 0.3° C. | 3 min. 15 sec. |
| Bleaching | 38.0 + 1.0° C. | 50 sec. |
| Fixing - 1 | 38.0 + 1.0° C. | 50 sec. |
| Fixing - 2 | 38.0 + 1.0° C. | 50 sec. |
| Stabilizing - 1 | 38.0 + 3.0° C. | 24 sec. |
| Stabilizing - 2 | 38.0 + 3.0° C. | 24 sec. |
| Stabilizing - 3 | 38.0 + 3.0° C. | 24 sec. |
| Drying | 60° C. | 1 min. 00 sec. |

The stabilizing bath is of a cascade system comprised of three sub-baths, of which the third sub-bath is supplied with the stabilizer replenisher and water, which are overflowed into the second sub-bath and then again overflowed therefrom into the first sub-bath. The fixing bath also is in the same cascade system.

Arrangements for the processing solutions used in the automatic processor were made in the following manner:

a. Color developer bath solution (21.0 liters)

Fifteen liters of warm water at 35° C. were put in the autoprocessor's color developer bath, and the previously prepared 70 color developer replenisher tablets for negative film processing use were put in and dissolved in the bath. Next, 21 tablets of the following composition that had been prepared as starter were added and completely dissolved in the bath, and then water was added to fill the whole up to the bath level line to thereby complete the bath solution.

| Color developing starter for color negative film | |
|---|---|
| Sodium bromide | 0.2 g |
| Sodium iodide | 1.7 mg |
| Sodium hydrogencarbonate | 1.5 g |
| Potassium carbonate | 2.4 g |

b. Bleacher bath solution (5.0 liters)

Three liters of warm water at 35° C. were put in the autoprocessor's bleacher bath; the previously prepared 250 bleacher replenisher tablets were added and dissolved in the tank; then 5 tablets of the following composition that had been prepared as starter were added to the bath; and then water was added to fill the whole up to the bath level line to thereby complete the bath solution.

| Bleaching starter for color negative film | |
|---|---|
| Potassium Bromide | 20 g |
| Sodium hydrogen carbonate | 3 g |
| Potassium carbonate | 7 g |

c. Fixer bath solution (first bath: 4.5 liters, second bath: 4.5 liters)

Three liters of warm water at 35° C. was put in each of the first and second baths; 112 tablets of the fixer replenisher for color negative film processing that had been prepared beforehand were added into each bath water and dissolved; and then water was added to fill the whole up to each bath level line to thereby complete each bath solution.

d. Stabilizer bath solution (first to third baths each capacity: 9.2 liters)

Three liters of warm water at 35° C. was put in each of the first, second and third baths; 53 tablets of the stabilizer replenisher for color negative film that had been prepared beforehand were added and dissolved in each bath; and water was added to fill the whole up to each bath level line to thereby complete each bath solution.

The above replenishing system was designed so as to have each replenisher consumed in an amount equivalent to one tablet each time when two 135-size 24 exp. films are processed, and at the same time to have replenishing water supplied in amounts of 40 ml to the color developer bath, 10 ml to the bleacher bath and 50 ml to the stabilizer bath. And when each bath solution is evaporated to cause its liquid level to be lowered by 1 centimeter or more, replenishing water is automatically supplied until the liquid level returns to normal.

Inventive Processing (A)

In the system that the whole overflow from the first stabilizer bath (stabilize-1) in the forefront of the stabilizer baths of the foregoing automatic processor is flowed into the immediately preceding fixer bath (fix-2), one tablet of the solid fixer replenisher is supplied for replenishment each time when two exposed film rolls are processed.

Inventive Processing (B)

In the system that the overflow from the foregoing first stabilizer bath (stabilize-1) is flowed into the solid processing chemicals dissolution device, one tablet of the solid fixer replenisher is cast into the device each time when two exposed film rolls are processed, and 50 ml of the dissolved fixer replenisher solution are supplied to the fixer bath (fix-2) of the autoprocessor.

Comparative Processing (C)

One tablet of the solid fixer replenisher and 50 ml of water are supplied to the foregoing fixer bath (fix-2) of the autoprocessor each time when two exposed film rolls are processed.

Processing run of 100 rolls/day of the above exposed film was repeated for 90 days, and after that, the exposed and processed film samples were measured to examine their unexposed areas' transmission densities (Dmin) and residual amounts of silver. And the conditions of solid deposits on the periphery of the liquid surface of the fixer bath and on the roller sections were examined visually. The results are shown in the following Table 2.

TABLE 2

| | D min | | | Residual Ag | Solid* |
|---|---|---|---|---|---|
| | B | G | R | (mg/dm$^2$) | deposit |
| Processing (A) | 0.65 | 0.60 | 0.27 | 0.1 | A |
| Processing (B) | 0.64 | 0.59 | 0.26 | 0.2 | A |

TABLE 2-continued

| | D min | | | Residual Ag | Solid* |
|---|---|---|---|---|---|
| | B | G | R | (mg/dm²) | deposit |
| Processing (C) | 0.75 | 0.64 | 0.33 | 1.2 | B–C |

A: No deposit at all.
B: Some deposit is found.
C: Conspicuous deposit is present TABLE 4-continued

| Process ing No. | Solid fixer $NH_4^+$ content (%) | Solid stabilizer additive |
|---|---|---|
| 3-8 | 0 | " |

The results are shown in Table 5.

TABLE 5

| Process- ing sys- tem No. | Processing (A) | | | | | Processing (B) | | | | | Processing (C) | | | | |
|---|---|---|---|---|---|---|---|---|---|---|---|---|---|---|---|
| | D min | | | Resid-* ual Ag | De- posit | D min | | | Resid-* ual Ag | De- posit | D min | | | Resid-* ual Ag | De- posit |
| | B | G | R | | | B | G | R | | | B | G | R | | |
| 3-1 | 0.59 | 0.54 | 0.24 | 0.02 | A | 0.59 | 0.53 | 0.24 | 0.01 | A | 0.59 | 0.53 | 0.35 | 0.10 | B–C |
| 3-2 | 0.60 | 0.54 | 0.24 | 0.04 | A | 0.59 | 0.54 | 0.24 | 0.04 | A | 0.59 | 0.54 | 0.32 | 0.22 | C |
| 3-3 | 0.60 | 0.55 | 0.24 | 0.05 | A | 0.60 | 0.54 | 0.24 | 0.06 | A | 0.60 | 0.54 | 0.33 | 0.36 | C |
| 3-4 | 0.61 | 0.55 | 0.25 | 0.10 | A | 0.60 | 0.55 | 0.25 | 0.09 | A | 0.60 | 0.55 | 0.34 | 0.51 | CC |
| 3-5 | 0.60 | 0.54 | 0.23 | 0.02 | A | 0.61 | 0.54 | 0.24 | 0.02 | A | 0.59 | 0.54 | 0.32 | 0.11 | B–C |
| 3-6 | 0.61 | 0.55 | 0.24 | 0.04 | A | 0.61 | 0.56 | 0.25 | 0.03 | A | 0.60 | 0.54 | 0.33 | 0.24 | C |
| 3-7 | 0.61 | 0.56 | 0.25 | 0.06 | A | 0.61 | 0.56 | 0.25 | 0.07 | A | 0.61 | 0.55 | 0.35 | 0.40 | C |
| 3-8 | 0.62 | 0.55 | 0.25 | 0.10 | B–A | 0.62 | 0.57 | 0.26 | 0.09 | B–A | 0.61 | 0.56 | 0.35 | 0.60 | CC |

Note: *mg/dm²

EXAMPLE 2

Experiments were made in the same manner as in the Processing (A) of Example 1 except that the adding amount of hexamethylenetetramine in Operation (K) of Example 1 was changed as shown in the following Table 3. Further, similar experiments were made using the compounds given in Table 3 in place of the hexamethylenetetramine. The results are shown in the following table.

TABLE 3

| | D min B | Deposit |
|---|---|---|
| Hexamethylenetetramine 3.6 g | 0.64 | A |
| Hexamethylenetetramine 1.8 g | 0.66 | A |
| Exemplified compound (3) 15 g | 0.59 | A |
| Exemplified compound (41) 20 g | 0.61 | A |
| Formaldehyde (37%) 10 g | 0.72 | C |
| Unadded | 0.70 | B |

In addition, experiments were made also in the same manner except that the exemplified compound (41) in Table 6 was replaced by exemplified compounds (2), (5), (15) and (24), then as good inventive effects as by the compound (41) were obtained.

EXAMPLE 3

Solid fixing chemicals were prepared in the same manner as in the Operation (I) of Example 1 except that the ammonium thiosulfate in Operation (I) was replaced by potassium thiosulfate which was added in the proportions as shown in Table 4. In addition, the solid stabilizer and the above solid fixer used in Example 2 were used in the combinations shown in Table 4 to make experiments in the same manner as in Example 1.

TABLE 4

| Process ing No. | Solid fixer $NH_4^+$ content (%) | Solid stabilizer additive |
|---|---|---|
| 3-1 | 50 | Exemplified Compound (3) |
| 3-2 | 20 | " |
| 3-3 | 10 | " |
| 3-4 | 0 | " |
| 3-5 | 50 | Exemplified Compound (41) |
| 3-6 | 20 | " |
| 3-7 | 10 | " |

EXAMPLE 4

The methods for preparation and processing of color photographic paper samples are explained.

Preparation of Color Photographic Paper

On the obverse side laminated with titanium oxide-containing polyethylene of a paper support with its reverse side laminated with polyethylene were coated the following layers having the compositions given below to thereby prepare a color photographic paper sample. The coating liquids were prepared as follows:

Layer 1 Coating Liquid

A mixture of 26.7 g of yellow coupler Y-1, 100 g of dye image stabilizer-ST-1, 6.67 g of ST-2, and 0.67 g of additive HQ-1 was added to and dissolved in a mixture of 6.67 g of high-boiling solvent DNP and 60 ml of ethyl acetate, and this solution was emulsifiedly dispersed by use of an ultrasonic homogenizer into 220 ml of an aqueous 10% gelatin solution containing 7 ml of 20% surfactant SU-1 whereby a yellow coupler dispersion was prepared. This dispersion was mixed with a blue-sensitive silver halide emulsion (containing 10 g of silver) prepared under the following conditions, whereby Layer 1 coating liquid was prepared.

Layers 2 to 7 were prepared in similar manner to the above Layer 1 coating liquid.

Hardener H-1 was added to Layers 2 and 4, and Hardener H-2 to Layer 7. As the coating aid, Surfactants SU-2 and SU-3 were added to adjust the surface tension of each coating liquid.

| Layer | Composition | Added amt (g/m²) |
|---|---|---|
| Layer 7 (protective layer) | Gelatin | 1.00 |
| Layer 6 (UV absorbing layer) | Gelatin | 0.40 |
| | UV absorbent UV-1 | 0.10 |
| | UV absorbent UV-2 | 0.04 |
| | UV absorbent UV-3 | 0.16 |
| | Antistain agent HQ-1 | 0.01 |
| | DNP | 0.20 |
| | PVP | 0.03 |
| | Antiirradiation dye AI-2 | 0.02 |
| Layer 5 (red-sensitive-layer) | Gelatin | 1.30 |
| | Red-sensitive silver halide emulsion Em-R, silver equivalent | 0.21 |

-continued

| Layer | Composition | Added amt ($g/m^2$) |
|---|---|---|
| | Cyan coupler C-1 | 0.17 |
| | Cyan coupler C-2 | 0.25 |
| | Dye image stabilizer ST-1 | 0.20 |
| | Antistain agent HQ-1 | 0.01 |
| | HBS-1 | 0.20 |
| | DOP | 0.20 |
| Layer 4 (UB absorbing layer) | Gelatin | 0.94 |
| | UV absorbent UV-1 | 0.28 |
| | UV absorbent UV-2 | 0.09 |
| | UV absorbent UV-3 | 0.38 |
| | Antistain agent HQ-1 | 0.03 |
| | DNP | 0.40 |
| Layer 3 (green-sensitive layer) | Gelatin | 1.40 |
| | Green-sensitive silver halide emulsion Em-G, silver equivalent | 0.19 |
| | Magenta coupler M-1 | 0.35 |
| | Dye image stabilizer ST-3 | 0.15 |

-continued

| Layer | Composition | Added amt ($g/m^2$) |
|---|---|---|
| | Dye image stabilizer ST-4 | 0.15 |
| | Dye image stabilizer ST-5 | 0.15 |
| | DNP | 0.20 |
| | Antiirradiation dye AI-1 | 0.01 |
| Layer 2 (interlayer) | Gelatin | 1.20 |
| | Antistain agent HQ-2 | 0.12 |
| | DIDP | 0.15 |
| Layer 1 (blue sensitive layer) | Gelatin | 1.20 |
| | Blue-sensitive silver halide emulsion Em-B, silver equivalent | 0.26 |
| | Yellow coupler Y-1 | 0.80 |
| | Dye image stabilizer ST-1 | 0.30 |
| | Dye image stabilizer ST-2 | 0.20 |
| | Antistain agent HQ-1 | 0.02 |
| | Antiirradiation dye AI-3 | 0.01 |
| | DNP | 0.20 |
| Support | Polyethylene-laminated paper | |

Y-1

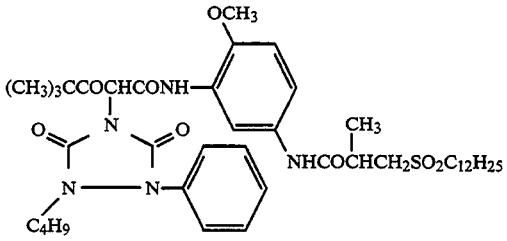

M-1

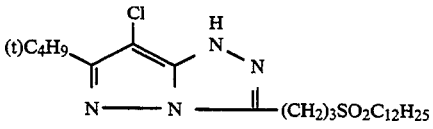

C-1

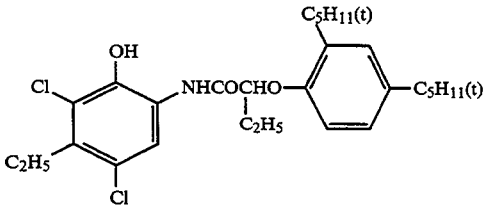

C-2

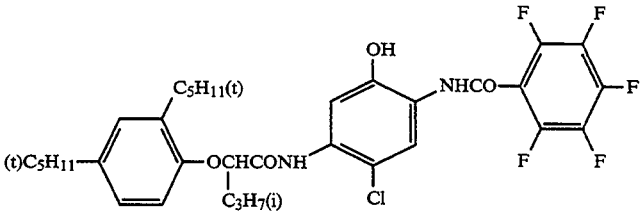

ST-1

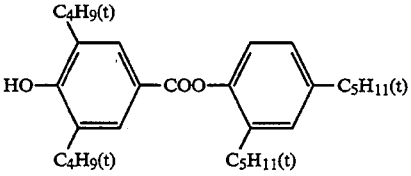

ST-2

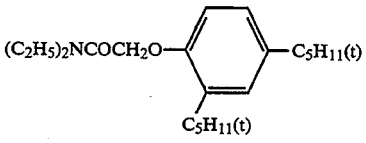

ST-3

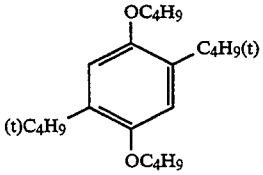

ST-4

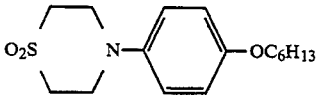

-continued

ST-5

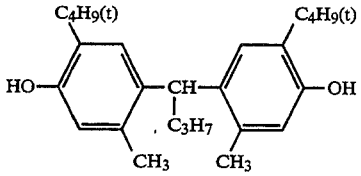

UV-1

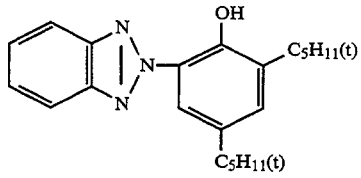

UV-2

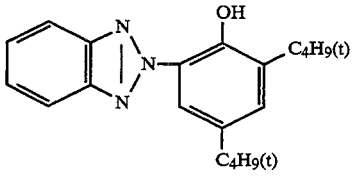

UV-3

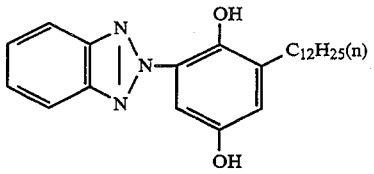

Dioctyl phthalate DOP

Dinonyl phthalate DNP

Diisodecyl phthalate DIDP

Polyvinyl pyrrolidone PVP

HQ-1

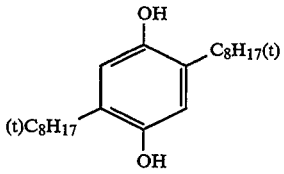

HQ-2

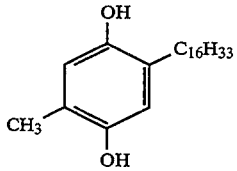

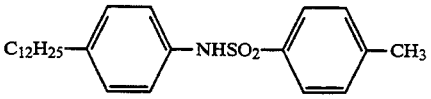

HBS-1

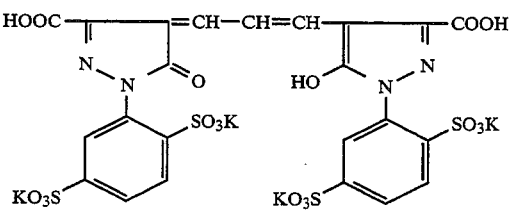

AI-1

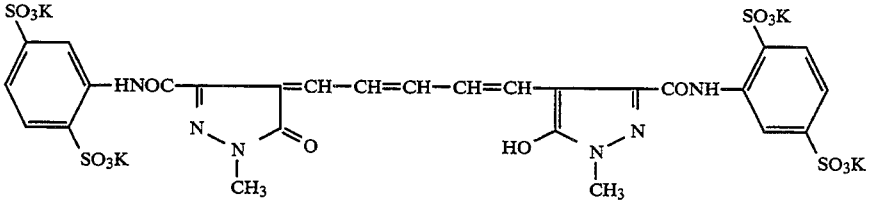

AI-2

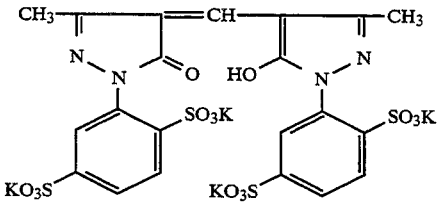

AI-3

SU-1

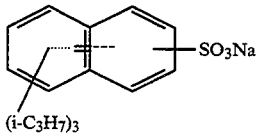

SU-2

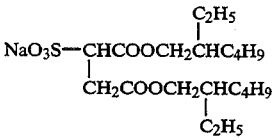

SU-3

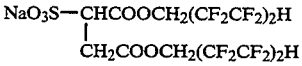

H-1

$(CH_2{=}CHSO_2CH_2)_4C$

H-2

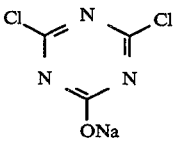

Preparation of Blue-Sensitive Silver Halide Emulsion

To 1000 ml of an aqueous 2% gelatin solution kept at a temperature of 40° C. were added spending 30 minutes the following Solution A and Solution B with pAg and pH being controlled to 6.5 and 3.0, respectively, and further added spending 180 minutes the following Solution D and Solution D with pAg and pH being controlled to 7.3 and 5.5, respectively.

In the above, the control of pAg was made according to the method described in JP O.P.I. No. 45437/1984, and the control of pH was made by using sulfuric acid or sodium hydroxide.

| | |
|---|---|
| Solution A | |
| Sodium chloride | 3.42 |
| Potassium bromide | 0.03 |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water to make | 600 ml |
| Solution D | |
| Silver nitrate | 300 g |
| Water to make | 600 ml |

Upon completion of the addition, the formed emulsion was desalted by using an aqueous 5% solution of Demol N, produced by Kawo Atlas Co., and an aqueous 20% magnesium sulfate solution, and then it was mixed with a gelatin solution, whereby a monodisperse cubic grains emulsion EMP-1, having an average grain diameter of 85 μm, a variation coefficient (σ/r) of 0.07 and a silver chloride content of 99.5 mol %, was obtained.

The above Emulsion EMP-1 was chemically ripened at 50° C. for 90 minutes with use of the following compounds to thereby obtain a blue-sensitive Emulsion Em-B.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

BS-1

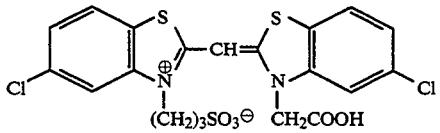

BS-2

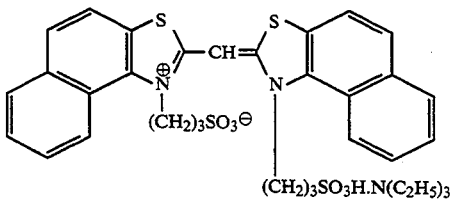

GS-1

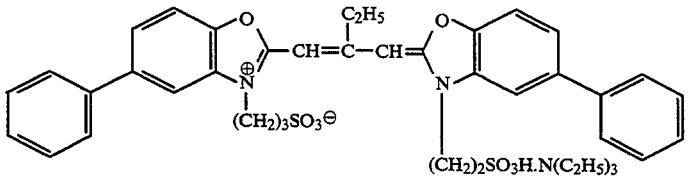

RS-1

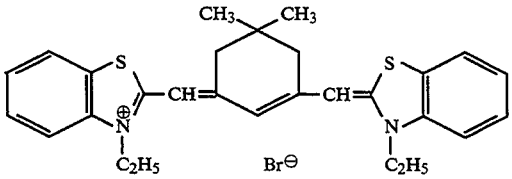

STAB-1

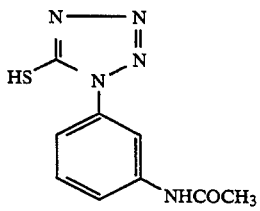

Preparation of Green-Sensitive Silver Halide Emulsion

A monodisperse cubic grains Emulsion EMP-2, having an average grain diameter of 0.43 μm, a variation coefficient of 0.08 and a silver chloride content of 99.5 mol %, was prepared in the same manner as in Emulsion EMP-1 except that the adding periods of time of Solutions A and B and of Solutions C and D were changed.

Emulsion EMP-2 was chemically ripened at 65° C. for 120 minutes with use of the following compounds to thereby obtain a green-sensitive silver halide Emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye BS-1 | $4 \times 10^{-4}$ mol/mol AgX |

Preparation of Red-Sensitive Silver Halide Emulsion

A monodisperse cubic grains Emulsion EMP-3, having an average grain diameter of 0.50 μm, a variation coefficient of 0.08 and a silver chloride content of 99.5 mol %, was prepared in the same manner as in Emulsion EMP-1 except that the adding periods of time of Solutions A and B and of Solutions C and D were changed.

Emulsion EMP-3 was chemically ripened at 60° C. for 90 minutes with use of the following compounds to thereby obtain a red-sensitive silver halide emulsion Em-R.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $4 \times 10^{-4}$ mol/mol AgX |

Color photographic paper processing chemicals tablets were prepared in the following procedures.

1) Color Developer Replenisher Tablets for Color Paper

Operation (A)

One hundred grams of color developing agent CD-3, 4-amino-3-methyl-N-ethyl-N-[β-(methanesulfonamido)ethyl]-aniline sulfate were pulverized into powder having an average particle size of 10 μm in an air-jet pulverizer; the powder is granulated by being subjected to 4.5 ml water spray treatment for about 5 minutes in a fluid-bed spray granulator; the granulated product was dried at 60° C. for 8 minutes; and then it was further dried under vacuum at 40° C. for two hours for almost complete dehydration.

Operation (B)

One hundred and eighty-five grams of disodium 2,2-hydroxyimino-bis-ethylenesulfonate were pulverized and water-sprayed to be granulated in the same manner as in Operation (A), in which the sprayed amount of water was 3.0 ml. The granulated product was dried at 50° C. for 10 minutes, and further dried under vacuum at 40° C. for 2 hours for almost complete dehydration.

Operation (C)

Thirty grams of Cinopal SFP (product of Ciba Geigy), 3.7 g of sodium sulfite, 500 g of potassium carbonate, 0.3 g of potassium bromide, 25 g of diethylenetriaminepentaacetic acid, 100 g of sodium p-toluenesulfonate and 200 g of potassium hydroxide were pulverized in the same manner as in Operation (A), and then uniformly mixed in a commercially available mixer. The obtained powdery mixture was sprayed with 200 ml of water to be granulated in the same manner as in Operation (A). Then the granulated product was dried at 70° C. for 15 minutes, and further dried under vacuum at 40° C. for two hours for almost complete dehydration.

Operation (D)

The granulated products prepared in Operations (A) to (C) were mixed uniformly for 10 minutes by using a mixer in a room at a temperature of 25° C. and a relative humidity of not more than 40%, and procedure steps of filling and compressing 2.93 g/tablet of the mixture by a Tough-Press Collect 1527HU-modified tabletting machine were repeated, whereby 300 color developer replenisher tablets for processing color photographic paper were prepared.

2) Bleach-Fix Replenisher Tablets for Color Photographic Paper

Operation (E)

Five hundred and fifty grams of ferric-potassium ethylenediaminetetraacetate and 20 g of ethylenediaminetetraacetic acid were pluverized and granulated in the same manner as in Operation (A), in which the sprayed amount of water used was 25.0 ml. After that, the granulated product was dried at 60° C. for 15 minutes, and further dried under vacuum at 40° C. for 2 hours for almost complet dehydration.

Operation (F)

Seventeen hundred and seventy grams of potassium thiosulfate, 200 g of sodium sulfite, 60 g of potassium bromide and 20 g of p-toluenesulfinic acid were pulverized and granulated in the same manner as in Operation (A), in which 15.0 ml of water was sprayed. After that, the granulated product was dried at 60° C. for 10 minutes, and further dried under vacuum at 40° C. for 2 hours for almost complete dehydration.

Operation (G)

The granulated products obtained in the above Operations (E) and (F) were mixed uniformly for 10 minutes by a mixer in a room at a temperature of 25° C. and a relative humidity of not more than 40%, and steps of filling and compressing 8.5 g/tablet of the mixture by a Tough-Press Collect 1527HU-modified type tabletting machine were repeated, whereby 300 bleach-fix replenisher tablets for color photographic paper were prepared.

3) Stabilizer Replenisher Tablets for Color Photographic Paper

Operation (H)

Ten grams of potassium carbonate and 200 g of sodium 1-hydroxyethane-1,1-diphosphonate were pulverized and granulated in the same manner as in Operation (A), in which 1.0 ml of water was sprayed. After that, the granulated product was dried at 75° C. for 3 minutes, and further dried under vacuum at 40° C. for 2 hours for almost complete dehydration.

Operation (I)

One hundred and fifty grams of Cinopal SFP, 300 g of sodium sulfite, 20 g of zinc sulfate, heptahydrated, and 150 g of ethylenediaminetetraacetic acid were pulverized and granulated in the same manner as in Operation (A), in which 10.0 ml of water were sprayed. After that, the granulated product was dried at 65° C. for 5 minutes, and further dried under vacuum at 40° C. for two hours for almost complete dehydration.

Operation (J)

The granulated products obtained by the above Operations (H) and (I) were mixed uniformly for 10 minutes in a room at 25° C. and a relative humidity of not more than 40%, and steps of filling and compressing 0.66 g/tablet of the mixture were repeated, whereby 1000 stabilizer replenisher tablets for color photographic paper were prepared.

A KONICA Color paper QA type processor CL-PP-718 of the type modified by being equipped with additional tablet supply, liquid level detection and warm water supply functions was used to make the following processing experiments. The standard processing steps and conditions for the automatic processor are as shown below.

| Processing step | Temperature | Time |
|---|---|---|
| Color develop | 35 ± 0.3° C. | 45 seconds |
| Bleach-fix | 35 ± 1.0° C. | 45 seconds |
| Stabilize-1 | 33 ± 3.0° C. | 30 seconds |
| Stabilize-2 | 33 ± 3.0° C. | 30 seconds |
| Stabilize-3 | 33 ± 3.0° C. | 30 seconds |
| Dry | 72 ± 5.0° C. | 40 seconds |

The stabilizer is of the cascade system, in which replenishment is made to its third bath, which is overflowed into its second bath, and then into its first bath.

The autoprocessor's processing solutions were prepared as follows.

(1) Color Developer Bath Solution (23.0 liters)

Eighteen liters of warm water at 35° C. were put in the autoprocessor's color developer bath, and 628 tablets of the in advance prepared color developer replenisher were cast and dissolved in the bath. Next, 23 tablets of the following chemicals prepared as a starter were cast in, and then warm water was added to fill the whole up to the level line in the bath to thereby complete the bath solution.

| Color developer starter for color photographic paper | |
|---|---|
| Potassium chloride | 4.0 g |
| Potassium hydrogencarbonate | 4.8 g |
| Potassium carbonate | 2.1 g |

(2) Bleach-Fix Solution (23.0 Liter)

Fifteen liters of warm water at 35° C. were put in the autoprocessor's bleach-fix bath, and 720 tablets of the in advance prepared bleach-fix replenisher were cast and dissolved in the bath. After that, warm water was added to fill the whole up to the level line of the bath to thereby complete the bath solution.

(3) Stabilizer Solution (15 Liters in Each of Baths 1 to 3)

Twelve liters of warm water at 35° C. were put in each of Baths 1, 2 and 3 for stabilizer, and 60 tablets of the in advance prepared stabilizer replenisher for color paper were cast and dissolved in each bath. Then warm water was added to fill the whole up to the level line of each bath to thereby complete the bath solution.

Subsequently, during the temperature control of the autoprocessor, 20 tablets of each replenisher prepared beforehand were set in each of the corresponding replenisher tablet suppliers provided to the automatic processor. These replenisher tablets were set so as to be cast one after one each time when 3200 $cm^2$ of color photographic paper are processed, and at the same time warm water is replenished in an amount of 25.6 ml to the color developer bath and 100 ml to the third stabilizer bath from the warm water supplier.

Prearrangements of the automatic processor were made as follows.

Processing (A)

The automatic processor was arranged so as to have the whole overflow from the first stabilizer bath flow into the bleach-fix bath and one replenisher tablet supplied each time when 3200 $cm^2$ of color photographic paper are processed.

Processing (B)

The automatic processor was arranged so as to have the first stabilizer bath overflow into the solid chemicals dissolution device, one bleach-fix replenisher tablet cast in the dissolution devide each time when 3200 $cm^2$ of color photographic paper are processed, and 100 m of the solution from the dissolution device supplied to the bleach-fix bath.

Processing (C)

The automatic processor was arranged so as to have one bleach-fix replenisher tablet and 100 ml of water supplied to the bleach-fix bath each time when 3200 $cm^2$ of color photographic paper are processed.

Ninety-day run of 15 $m^2$/day processing of the foregoing color photographic paper sample exposed beforehand was made under the above conditions, and after that, a color paper sample exposed through an optical wedge in the usual manner was processed in the baths, and its unexposed area's spectral reflection density (D min) at 660 nm and its residual silver amount were measured. Also, the conditions of the solid deposit on the periphery of the liquid surface of the bleach-fix bath and on the rollers section were examined visually.

The results are shown in the following Table 6.

TABLE 6

| | Spectral reflection density at 660 nm | Residual silver weight (mg/$dm^2$) | Solid deposit |
|---|---|---|---|
| Processing (A) | 0.007 | 0.0 | A |
| Processing (B) | 0.009 | 0.1 | A |
| Processing (C) | 0.031 | 0.5 | C |

EXAMPLE 5

Running processing experiments were made in the same manner as in the Processings (A) and (B) of Example 1 except that the silver iodide content of the color negative film sample in Example 1 was changed to prepare samples b-1 to b-5. The results are shown in Table 7.

TABLE 7

| Sample No. | AgI mol % | D min B | D min G | D min R | Residual silver (mg/$dm^2$) | |
|---|---|---|---|---|---|---|
| Processing (A) | | | | | | |
| b-1 | 1.0 | 0.79 | 0.71 | 0.39 | 0.1 | Comparative |
| b-2 | 2.0 | 0.75 | 0.69 | 0.33 | 0.1 | Comparative |
| b-3 | 4.0 | 0.71 | 0.67 | 0.32 | 0.1 | Comparative |
| b-4 | 6.0 | 0.65 | 0.59 | 0.26 | 0.1 | Invention |
| b-5 | 8.0 | 0.65 | 0.58 | 0.26 | 0.1 | " |
| Processing (B) | | | | | | |
| b-1 | 1.0 | 0.78 | 0.70 | 0.38 | 0.1 | Comparative |
| b-2 | 2.0 | 0.75 | 0.67 | 0.33 | 0.1 | Comparative |
| b-3 | 4.0 | 0.70 | 0.64 | 0.31 | 0.1 | Invention |
| b-4 | 6.0 | 0.65 | 0.59 | 0.26 | 0.1 | " |
| b-5 | 8.0 | 0.64 | 0.59 | 0.26 | 0.1 | " |

EXAMPLE 6

Running processing experiments were made in the same manner as in the processings (A) and (B) of Example 4 except that the silver chloride content ratio of Emulsions EMP-1, EMP-2 and EMP-3 of the color paper sample in Example 4 was changed as shown in Table 8 to prepare Samples a-1 through a-6. The results are shown in Table 8.

TABLE 8

| Sample No. | AgCl mol % | Reflection density at 660 nm | Residual silver (mg/$dm^2$) | |
|---|---|---|---|---|
| Processing (A) | | | | |
| a-1 | 70 | 0.026 | 0.5 | Comparative |
| a-2 | 80 | 0.018 | 0.3 | " |
| a-3 | 90 | 0.008 | 0.1 | Invention |
| a-4 | 92 | 0.008 | 0.0 | " |
| a-5 | 95 | 0.007 | 0.0 | " |
| a-6 | 98 | 0.007 | 0.0 | " |
| Processing (B) | | | | |

TABLE 8-continued

| Sample No. | AgCl mol % | Reflection density at 660 nm | Residual silver (mg/dm²) | |
|---|---|---|---|---|
| a-1 | 70 | 0.031 | 0.68 | Comparative |
| a-2 | 80 | 0.024 | 0.42 | " |
| a-3 | 90 | 0.009 | 0.11 | Invention |
| a-4 | 92 | 0.008 | 0.1 | " |
| a-5 | 95 | 0.008 | 0.1 | " |
| a-6 | 98 | 0.007 | 0.1 | " |

EXAMPLE 7

Running processing experiments were made in the same manner as in Example 1 except that the replenishing amount of warm water to the stabilizer Bath-3 in Operation (A) of Example 1 was adjusted to change the amount of overflow from the stabilizer Bath-1 as shown in Table 9. The results are shown in Table 9.

TABLE 9

| Amt of Overflow from Stabilizer Bath-1 (ml/m²) | D min B | D min G | D min R | Residual silver (mg/dm²) | |
|---|---|---|---|---|---|
| Processing (A) | | | | | |
| 50 | 0.65 | 0.59 | 0.26 | 0.01 | Invention |
| 70 | 0.65 | 0.59 | 0.26 | 0.02 | " |
| 90 | 0.65 | 0.59 | 0.26 | 0.1 | " |
| 100 | 0.66 | 0.60 | 0.27 | 0.1 | " |
| 150 | 0.66 | 0.61 | 0.27 | 0.2 | " |
| 200 | 0.80 | 0.67 | 0.35 | 0.8 | Comparative |

EXAMPLE 8

Running processing experiments were made in the same manner as in Example 4 except that the replenishing amount of warm water to the stabilizer Bath-3 in Processing (A) of Example 4 was adjusted to change the amount of overflow from the stabilizer Bath-1 as shown in Table 10. The results are shown in Table 10.

TABLE 10

| Amt of overflow from stabilizer Bath-1 (ml/m²) | Reflection density at 660 nm | Residual silver (mg/dm²) | |
|---|---|---|---|
| Processing (A) | | | |
| 400 | 0.06 | 0.0 | Invention |
| 500 | 0.07 | 0.0 | " |
| 600 | 0.07 | 0.0 | " |
| 650 | 0.08 | 0.0 | " |
| 670 | 0.015 | 0.3 | Comparative |
| 700 | 0.020 | 0.5 | " |
| 800 | 0.024 | 0.5 | " |

EXAMPLE 9

Running processing experiments were made in the same manner as in Example 4 except that the ferric-potassium ethylenediaminetetraacetate monohydrate used in Operation (E) of Example 4 was replaced by ferric-potassium salts of exemplified Compounds A-I-1 and A-II-1. The results were as good as those of Example 4.

What is claimed is:

1. A method for processing an imagewise exposed silver halide photographic light sensitive material comprising the steps of developing the light sensitive material with a developing solution comprising a developing agent, treating the light sensitive material with a fixing capacity-having solution, and then treating the light sensitive material with a processing solution (S), wherein part of or the whole of overflow from a tank containing the processing solution (S) is allowed to flow into a tank containing the fixing capacity-having solution, and wherein solid processing chemicals are added to the fixing capacity-having solution or the overflow from the tank containing the processing solution (S).

2. The method for processing a photographic light sensitive material of claim 1, wherein the processing solution (S) contains substantially no formaldehyde.

3. The method for processing a photographic light sensitive material of claim 2, wherein the processing solution (S) is a stabilizing solution.

4. The method for processing a photographic light sensitive material of claim 1, wherein the fixing capacity-having solution is a fixing solution or a bleach-fix solution.

5. The method for processing a photographic light sensitive material of claim 1, the method further comprising bleaching the light sensitive material, subsequently to the step of developing, with a bleaching solution.

6. The method for processing a photographic light sensitive material of claim 1, wherein the silver halide photographic light sensitive material comprises a support having thereon a silver halide emulsion layer containing silver halide grains having a silver chloride content of 90 mol % or more, and the total amount of the overflow from the tank containing the processing solution (S) is not more than 660 ml per m² of said photographic light sensitive material.

7. The method for processing a photographic light sensitive material of claim 1, wherein the silver halide photographic light sensitive material comprises a support having thereon a silver halide emulsion layer containing silver halide grains having a silver iodide content of 6 mol % or less, and the total amount of the overflow from the tank containing the processing solution (S) is not more than 2000 ml per m² of the photographic light sensitive material.

8. The method of claim 1 wherein said solid processing chemicals are in the form of a tablet having a bulk density of 1.2 to 2.0 g/cm³.

* * * * *